US010563850B2

(12) United States Patent
Danesh

(10) Patent No.: US 10,563,850 B2
(45) Date of Patent: Feb. 18, 2020

(54) OUTER CASING FOR A RECESSED LIGHTING FIXTURE

(71) Applicant: DMF, Inc., Carson, CA (US)

(72) Inventor: Michael D. Danesh, Beverly Hills, CA (US)

(73) Assignee: DMF, Inc., Carson, CA (US)

( * ) Notice: Subject to any disclaimer, the term of this patent is extended or adjusted under 35 U.S.C. 154(b) by 319 days.

(21) Appl. No.: 15/132,875

(22) Filed: Apr. 19, 2016

(65) Prior Publication Data

US 2016/0312987 A1 Oct. 27, 2016

Related U.S. Application Data

(60) Provisional application No. 62/151,308, filed on Apr. 22, 2015.

(51) Int. Cl.

| | |
|---|---|
| ***F21V 21/14*** | (2006.01) |
| ***F21S 8/02*** | (2006.01) |
| *F21V 21/04* | (2006.01) |
| *F21V 23/06* | (2006.01) |

(52) U.S. Cl.

CPC ..... *F21V 21/14* (2013.01); *F21S 8/024* (2013.01); *F21S 8/026* (2013.01); *F21V 21/04* (2013.01); *F21V 23/06* (2013.01)

(58) Field of Classification Search

CPC ..... F21S 8/026; F21S 8/024

See application file for complete search history.

(56) References Cited

U.S. PATENT DOCUMENTS

| | | | |
|---|---|---|---|
| 1,471,340 | A | 10/1923 | Knight |
| 2,038,784 | A | 4/1936 | Ghadiali |
| 2,197,737 | A | 4/1940 | Appleton |
| 2,528,989 | A | 11/1950 | Ammells |
| 2,642,246 | A | 6/1953 | Larry |
| D180,844 | S | 8/1957 | Poliakoff |
| 3,023,920 | A | 3/1962 | Cook et al. |
| 3,422,261 | A | 1/1969 | McGinty |

(Continued)

FOREIGN PATENT DOCUMENTS

| | | | |
|---|---|---|---|
| CA | 2243934 | C | 6/2002 |
| CA | 2502637 | A1 | 9/2005 |

(Continued)

OTHER PUBLICATIONS

Non-Final Office Action, dated Dec. 15, 2016, U.S. Appl. No. 14/184,601.

(Continued)

*Primary Examiner* — Jong-Suk (James) Lee
*Assistant Examiner* — Christopher E Dunay
(74) *Attorney, Agent, or Firm* — Smith Baluch LLP

(57) ABSTRACT

The recessed lighting fixture includes a light source module and a driver housed within a unified casting, and within a shared outer casing. The outer casing may be coupled to a hangar holder that is movably coupled to a corresponding hangar bar. The outer casing, including the light source module and driver installed therein, may move both 1) in the length direction of the hangar bar and 2) perpendicular to the length direction of the hangar bar. The recessed lighting fixture may have less bulk and size than traditional recessed lighting fixtures. Other embodiments are also described and claimed.

14 Claims, 8 Drawing Sheets

(56) References Cited

U.S. PATENT DOCUMENTS 3,460,299 A 8/1969 Wilson
3,650,046 A 3/1972 Skinner
3,711,053 A 1/1973 Drake
D227,989 S 7/1973 Geisel
3,812,342 A 5/1974 Mcnamara
D245,905 S 9/1977 Taylor
4,088,827 A 5/1978 Kohaut
4,176,758 A 12/1979 Glick
4,280,169 A 7/1981 Allen
4,399,497 A 8/1983 Druffel
4,520,435 A 5/1985 Baldwin
4,601,145 A 7/1986 Wilcox
4,723,747 A 2/1988 Karp et al.
4,729,080 A 3/1988 Fremont et al.
4,754,377 A 6/1988 Wenman
4,930,054 A 5/1990 Krebs
5,216,203 A 6/1993 Gower
5,239,132 A 8/1993 Bartow
5,250,269 A 10/1993 Langer et al.
5,266,050 A 11/1993 O'Neil et al.
5,382,752 A 1/1995 Reyhan et al.
5,465,199 A 11/1995 Bray et al.
5,505,419 A 4/1996 Gabrius
5,544,870 A 8/1996 Kelly et al.
5,562,343 A 10/1996 Chan et al.
5,571,993 A 11/1996 Jones et al.
5,580,158 A 12/1996 Aubrey et al.
5,588,737 A 12/1996 Kusmer
5,603,424 A 2/1997 Bordwell et al.
5,613,338 A 3/1997 Esposito
D381,111 S 7/1997 Lecluze
5,662,413 A 9/1997 Akiyama et al.
D386,277 S 11/1997 Lecluze
D387,466 S 12/1997 Lecluze
5,738,436 A * 4/1998 Cummings ..... F21S 8/026
362/148
5,836,678 A 11/1998 Wright et al.
5,942,726 A 8/1999 Reiker
5,944,412 A 9/1999 Janos et al.
5,957,573 A 9/1999 Wedekind et al.
6,082,878 A 7/2000 Doubek et al.
6,105,334 A 8/2000 Monson et al.
6,161,910 A 12/2000 Reisenauer et al.
6,170,685 B1 1/2001 Currier
6,174,076 B1 1/2001 Petrakis et al.
6,176,599 B1 1/2001 Farzen
6,267,491 B1 7/2001 Parrigin
6,332,597 B1 12/2001 Korcz et al.
6,350,043 B1 2/2002 Gloisten
6,364,511 B1 4/2002 Cohen
6,402,112 B1 6/2002 Thomas et al.
D461,455 S 8/2002 Forbes
6,461,016 B1 10/2002 Jamison et al.
6,474,846 B1 11/2002 Kelmelis et al.
6,491,413 B1 12/2002 Benesohn
D468,697 S 1/2003 Straub, Jr.
6,515,313 B1 2/2003 Ibbetson et al.
6,583,573 B2 6/2003 Bierman
6,585,389 B2 7/2003 Bonazzi
6,600,175 B1 7/2003 Baretz et al.
D478,872 S 8/2003 Heggem
6,657,236 B1 12/2003 Thibeault et al.
6,666,419 B1 12/2003 Vrame
D488,583 S 4/2004 Benghozi
6,719,438 B2 4/2004 Sevack et al.
6,758,578 B1 7/2004 Chou
6,777,615 B1 8/2004 Gretz
6,827,229 B2 12/2004 Dinh et al.
6,906,352 B2 6/2005 Edmond et al.
D509,314 S 9/2005 Rashidi
6,948,829 B2 9/2005 Verdes et al.
6,958,497 B2 10/2005 Emerson et al.
6,964,501 B2 11/2005 Ryan
D516,235 S 2/2006 Rashidi
7,064,269 B2 6/2006 Smith
D528,673 S 9/2006 Maxik et al.
D531,740 S 11/2006 Maxik
D532,532 S 11/2006 Maxik
7,148,420 B1 12/2006 Johnson et al.
7,154,040 B1 12/2006 Tompkins
7,170,015 B1 1/2007 Roesch et al.
D536,349 S 2/2007 Humber et al.
D537,039 S 2/2007 Pincek
D539,229 S 3/2007 Murphey
7,186,008 B2 3/2007 Patti
7,190,126 B1 3/2007 Paton
7,211,833 B2 5/2007 Slater, Jr. et al.
7,213,940 B1 5/2007 Van De Ven et al.
D547,889 S 7/2007 Huang
D552,969 S 10/2007 Bobrowski et al.
D553,267 S 10/2007 Yuen
D555,106 S 11/2007 Pape et al.
D556,144 S 11/2007 Dinh
7,297,870 B1 11/2007 Sartini
7,312,474 B2 12/2007 Emerson et al.
7,320,536 B2 1/2008 Petrakis et al.
D561,372 S 2/2008 Yan
D561,373 S 2/2008 Yan
7,335,920 B2 2/2008 Denbaars et al.
D563,896 S 3/2008 Greenslate
7,347,580 B2 3/2008 Blackman et al.
D570,012 S 5/2008 Huang
7,374,308 B2 5/2008 Sevack et al.
D570,504 S 6/2008 Maxik et al.
D570,505 S 6/2008 Maxik et al.
7,399,104 B2 7/2008 Rappaport
D578,677 S 10/2008 Huang
7,431,482 B1 10/2008 Morgan et al.
7,432,440 B2 10/2008 Hull et al.
7,442,883 B2 10/2008 Jolly et al.
7,446,345 B2 11/2008 Emerson et al.
7,473,005 B2 1/2009 O'Brien
7,488,097 B2 2/2009 Reisenauer et al.
7,494,258 B2 2/2009 McNaught
7,503,145 B2 3/2009 Newbold et al.
7,524,089 B2 4/2009 Park
D591,894 S 5/2009 Flank
7,534,989 B2 5/2009 Suehara et al.
D596,154 S 7/2009 Rivkin
7,566,154 B2 7/2009 Gloisten et al.
D599,040 S 8/2009 Alexander et al.
D600,836 S 9/2009 Hanley et al.
7,588,359 B2 9/2009 Coushaine et al.
7,592,583 B2 9/2009 Page et al.
D606,696 S 12/2009 Chen et al.
7,625,105 B1 12/2009 Johnson
7,628,513 B2 12/2009 Chiu
7,651,238 B2 1/2010 O'Brien
7,654,705 B2 2/2010 Czech et al.
D611,650 S 3/2010 Broekhoff
7,670,021 B2 3/2010 Chou
7,673,841 B2 3/2010 Wronski
7,677,766 B2 3/2010 Boyer
7,692,182 B2 4/2010 Bergmann et al.
7,704,763 B2 4/2010 Fujii et al.
D616,118 S 5/2010 Thomas et al.
7,722,208 B1 5/2010 Dupre et al.
7,722,227 B2 5/2010 Zhang et al.
7,735,795 B2 6/2010 Wronski
7,735,798 B2 6/2010 Kojima
7,748,887 B2 7/2010 Zampini, II et al.
7,766,518 B2 8/2010 Piepgras et al.
7,769,192 B2 8/2010 Takagi et al.
7,771,082 B2 8/2010 Peng
7,771,094 B2 8/2010 Goode
D624,692 S 9/2010 MacKin et al.
D625,847 S 10/2010 Maglica
D625,876 S 10/2010 Chen et al.
D627,727 S 11/2010 Alexander et al.
7,828,465 B2 11/2010 Roberge et al.
D629,366 S 12/2010 Ericson et al.
7,871,184 B2 1/2011 Peng
7,874,539 B2 1/2011 Wright et al.
7,874,709 B1 1/2011 Beadle

(56) References Cited

U.S. PATENT DOCUMENTS

D633,224 S 2/2011 Lee
D636,903 S 4/2011 Torenbeek
D637,339 S 5/2011 Hasan et al.
D637,340 S 5/2011 Hasan et al.
7,950,832 B2 5/2011 Tanaka et al.
D639,499 S 6/2011 Choi et al.
D640,819 S 6/2011 Pan
7,959,332 B2 6/2011 Tickner et al.
7,967,480 B2 6/2011 Pickard et al.
D642,317 S 7/2011 Rashidi
7,972,035 B2 7/2011 Boyer
7,972,043 B2 7/2011 Schutte
D642,536 S 8/2011 Robinson
D643,970 S 8/2011 Kim et al.
D646,011 S 9/2011 Rashidi
8,013,243 B2 9/2011 Korcz et al.
8,038,113 B2 10/2011 Fryzek et al.
D648,476 S 11/2011 Choi et al.
D648,477 S 11/2011 Kim et al.
D650,115 S 12/2011 Kim et al.
8,070,328 B1 12/2011 Knoble et al.
8,096,670 B2 1/2012 Trott et al.
D654,205 S 2/2012 Rashidi
D656,263 S 3/2012 Ogawa et al.
8,142,057 B2 3/2012 Roos et al.
8,152,334 B2 4/2012 Krogman
D658,788 S 5/2012 Dudik et al.
D658,802 S 5/2012 Chen
D659,862 S 5/2012 Tsai
D659,879 S 5/2012 Rashidi
D660,814 S 5/2012 Wilson
8,182,116 B2 5/2012 Zhang et al.
8,201,968 B2 6/2012 Maxik et al.
D663,058 S 7/2012 Pan
D663,466 S 7/2012 Rashidi
D664,274 S 7/2012 de Visser et al.
D664,705 S 7/2012 Kong et al.
8,215,805 B2 7/2012 Cogliano et al.
8,220,970 B1 7/2012 Khazi et al.
8,226,270 B2 7/2012 Yamamoto et al.
8,240,630 B2 8/2012 Wronski
D667,155 S 9/2012 Rashidi
8,262,255 B1 9/2012 Rashidi
D668,372 S 10/2012 Renshaw et al.
D668,809 S 10/2012 Rashidi
D669,198 S 10/2012 Qui
D669,199 S 10/2012 Chuang
D669,620 S 10/2012 Rashidi
8,277,090 B2 10/2012 Fryzek et al.
8,308,322 B2 11/2012 Santiago et al.
D673,869 S 1/2013 Yu
D676,263 S 2/2013 Birke
D676,814 S 2/2013 Paul
8,376,593 B2 2/2013 Bazydola et al.
D677,417 S 3/2013 Rashidi
D677,634 S 3/2013 Korcz et al.
D679,047 S 3/2013 Tickner et al.
8,403,533 B1 3/2013 Paulsel
8,403,541 B1 3/2013 Rashidi
D681,259 S 4/2013 Kong
8,408,759 B1 4/2013 Rashidi
D682,459 S 5/2013 Gordin et al.
D683,063 S 5/2013 Lopez et al.
D683,890 S 6/2013 Lopez et al.
D684,269 S 6/2013 Wang et al.
D684,719 S 6/2013 Rashidi
D685,118 S 6/2013 Rashidi
D685,120 S 6/2013 Rashidi
8,454,204 B1 * 6/2013 Chang ..... F21V 7/041
362/294
D685,507 S 7/2013 Sun
D687,586 S 8/2013 Rashidi
D687,587 S 8/2013 Rashidi
D687,588 S 8/2013 Rashidi
D687,980 S 8/2013 Gravely et al.
D688,405 S 8/2013 Kim et al.
D690,049 S 9/2013 Rashidi
D690,864 S 10/2013 Rashidi
D690,865 S 10/2013 Rashidi
D690,866 S 10/2013 Rashidi
D691,314 S 10/2013 Rashidi
D691,315 S 10/2013 Samson
D691,763 S 10/2013 Hand et al.
8,550,669 B2 10/2013 Macwan et al.
D693,043 S 11/2013 Schmalfuss et al.
D693,517 S 11/2013 Davis
D694,456 S 11/2013 Rowlette, Jr. et al.
8,573,816 B2 11/2013 Negley et al.
D695,441 S 12/2013 Lui et al.
D696,446 S 12/2013 Huh
D696,447 S 12/2013 Huh
D696,448 S 12/2013 Huh
8,602,601 B2 12/2013 Khazi et al.
D698,067 S 1/2014 Rashidi
D698,068 S 1/2014 Rashidi
8,622,361 B2 1/2014 Wronski
D698,985 S 2/2014 Lopez et al.
D699,384 S 2/2014 Rashidi
D699,687 S 2/2014 Baldwin et al.
D700,387 S 2/2014 Snell
8,641,243 B1 2/2014 Rashidi
8,659,034 B2 2/2014 Baretz et al.
D701,175 S 3/2014 Baldwin et al.
D701,466 S 3/2014 Clifford et al.
8,672,518 B2 3/2014 Boomgaarden et al.
D702,867 S 4/2014 Kim et al.
D703,843 S 4/2014 Cheng
8,684,569 B2 4/2014 Pickard et al.
D705,472 S 5/2014 Huh
8,727,582 B2 5/2014 Brown et al.
D708,381 S 7/2014 Rashidi
8,777,449 B2 7/2014 Ven et al.
D710,529 S 8/2014 Lopez et al.
8,801,217 B2 8/2014 Oehle et al.
8,820,985 B1 9/2014 Tam et al.
8,833,013 B2 9/2014 Harman
D714,989 S 10/2014 Rowlette, Jr. et al.
8,870,426 B2 10/2014 Biebl et al.
8,890,414 B2 11/2014 Rowlette, Jr. et al.
D721,845 S 1/2015 Lui et al.
8,939,418 B2 1/2015 Green et al.
D722,296 S 2/2015 Taylor
D722,977 S 2/2015 Hagarty
D722,978 S 2/2015 Hagarty
8,950,898 B2 2/2015 Catalano
D726,363 S 4/2015 Danesh
D726,949 S 4/2015 Redfern
9,004,435 B2 4/2015 Wronski
9,039,254 B2 5/2015 Danesh
D731,689 S 6/2015 Bernard et al.
9,062,866 B1 6/2015 Christ et al.
9,065,264 B2 6/2015 Cooper et al.
9,068,719 B2 6/2015 Van De Ven et al.
D734,525 S 7/2015 Gordin et al.
D735,012 S 7/2015 Cowie
D735,142 S 7/2015 Hagarty
9,078,299 B2 7/2015 Ashdown
D739,590 S 9/2015 Redfern
9,140,441 B2 9/2015 Goelz et al.
D742,325 S 10/2015 Leung
9,151,457 B2 10/2015 Pickard et al.
9,151,477 B2 10/2015 Pickard et al.
9,217,560 B2 12/2015 Harbers et al.
9,222,661 B2 12/2015 Kim et al.
9,239,131 B1 1/2016 Wronski et al.
9,285,103 B2 3/2016 Van De Ven et al.
9,291,319 B2 3/2016 Kathawate et al.
9,301,362 B2 3/2016 Dohn et al.
D754,078 S 4/2016 Baldwin et al.
D754,079 S 4/2016 Baldwin et al.
D754,605 S 4/2016 McMillan
9,303,812 B2 4/2016 Green et al.
9,310,038 B2 4/2016 Athalye
9,322,543 B2 4/2016 Hussell et al.

(56) References Cited

U.S. PATENT DOCUMENTS 9,347,655 B2 5/2016 Boomgaarden et al.
9,366,418 B2 6/2016 Gifford
9,371,966 B2 6/2016 Rowlette, Jr. et al.
D762,181 S 7/2016 Lin
9,395,051 B2 7/2016 Hussell et al.
D762,906 S 8/2016 Jeswani et al.
D764,079 S 8/2016 Wu
9,417,506 B1 8/2016 Tirosh
D766,185 S 9/2016 Hagarty
D767,199 S 9/2016 Wronski et al.
9,447,917 B1 9/2016 Wronski et al.
D768,325 S 10/2016 Xu
D768,326 S 10/2016 Guzzini
D769,501 S 10/2016 Jeswani et al.
D770,065 S 10/2016 Tittle
9,476,552 B2 10/2016 Myers et al.
D776,324 S 1/2017 Gierl et al.
D777,967 S 1/2017 Redfern
9,534,751 B2 1/2017 Maglica et al.
D778,241 S 2/2017 Holbrook et al.
D778,484 S 2/2017 Guzzini
D779,100 S 2/2017 Redfern
9,581,302 B2 2/2017 Danesh
9,599,315 B1 3/2017 Harpenau et al.
9,605,910 B2 3/2017 Swedberg et al.
D785,228 S 4/2017 Guzzini
D786,472 S 5/2017 Redfern
D786,474 S 5/2017 Fujisawa
D788,330 S 5/2017 Johnson et al.
D790,102 S 6/2017 Guzzini
9,673,597 B2 6/2017 Lee
9,689,541 B2 6/2017 Wronski
D791,709 S 7/2017 Holton
D791,711 S 7/2017 Holton
D791,712 S 7/2017 Holton
9,696,021 B2 7/2017 Wronski
9,702,516 B1 7/2017 Vasquez et al.
D795,820 S 8/2017 Wengreen
9,732,904 B1 8/2017 Wronski
9,739,464 B2 8/2017 Wronski
9,791,111 B1 10/2017 Huang et al.
9,803,839 B2 * 10/2017 Visser ..... F21V 21/047
D805,660 S 12/2017 Creasman et al.
D809,176 S 1/2018 Partington
9,863,619 B2 1/2018 Mak
D809,465 S 2/2018 Keirstead
9,964,266 B2 5/2018 Danesh
D820,494 S 6/2018 Cohen
9,995,441 B2 6/2018 Power et al.
D824,494 S 7/2018 Martins et al.
D832,218 S 10/2018 Wronski et al.
D833,977 S 11/2018 Danesh et al.
10,139,059 B2 11/2018 Danesh
D836,976 S 1/2019 Reese et al.
D848,375 S 5/2019 Danesh et al.
D851,046 S 6/2019 Peng et al.
2002/0172047 A1 11/2002 Ashley
2003/0006353 A1 1/2003 Dinh et al.
2003/0016532 A1 1/2003 Reed
2003/0021104 A1 1/2003 Tsao
2003/0161153 A1 8/2003 Patti
2004/0001337 A1 1/2004 Defouw et al.
2004/0156199 A1 8/2004 Rivas et al.
2005/0225966 A1 10/2005 Hartmann et al.
2005/0227536 A1 10/2005 Gamache et al.
2005/0231962 A1 10/2005 Koba et al.
2005/0237746 A1 10/2005 Yiu
2006/0005988 A1 1/2006 Jorgensen
2006/0158873 A1 7/2006 Newbold et al.
2006/0198126 A1 9/2006 Jones
2006/0215408 A1 9/2006 Lee
2006/0237601 A1 10/2006 Rinderer
2006/0243877 A1 11/2006 Rippel
2006/0250788 A1 11/2006 Hodge et al.
2007/0035951 A1 2/2007 Tseng
2007/0185675 A1 8/2007 Papamichael et al.
2007/0200039 A1 8/2007 Petak
2007/0206374 A1 9/2007 Petrakis et al.
2008/0002414 A1 1/2008 Miletich et al.
2008/0112168 A1 5/2008 Pickard et al.
2008/0112170 A1 5/2008 Trott
2008/0112171 A1 5/2008 Patti et al.
2008/0137347 A1 6/2008 Trott et al.
2008/0165545 A1 * 7/2008 O'Brien ..... F21S 8/02
362/364
2008/0232116 A1 9/2008 Kim
2008/0247181 A1 10/2008 Dixon
2009/0003009 A1 1/2009 Tessnow et al.
2009/0034261 A1 2/2009 Grove
2009/0080189 A1 3/2009 Wegner
2009/0086484 A1 4/2009 Johnson
2009/0135613 A1 5/2009 Peng
2009/0141500 A1 6/2009 Peng
2009/0141506 A1 6/2009 Lan et al.
2009/0141508 A1 6/2009 Peng
2009/0147517 A1 6/2009 Li
2009/0161356 A1 6/2009 Negley et al.
2009/0237924 A1 9/2009 Ladewig
2009/0280695 A1 11/2009 Sekela et al.
2009/0283292 A1 11/2009 Lehr
2009/0290343 A1 11/2009 Brown et al.
2010/0014282 A1 1/2010 Danesh
2010/0061108 A1 3/2010 Zhang et al.
2010/0110690 A1 5/2010 Hsu et al.
2010/0110698 A1 5/2010 Harwood et al.
2010/0148673 A1 6/2010 Stewart et al.
2010/0149822 A1 6/2010 Cogliano et al.
2010/0165643 A1 7/2010 Russo et al.
2010/0244709 A1 9/2010 Steiner et al.
2010/0246172 A1 9/2010 Liu
2010/0259919 A1 10/2010 Khazi et al.
2010/0270903 A1 10/2010 Jao et al.
2010/0284185 A1 11/2010 Ngai
2010/0302778 A1 12/2010 Dabiet et al.
2011/0043040 A1 2/2011 Porter et al.
2011/0063831 A1 3/2011 Cook
2011/0068687 A1 3/2011 Takahasi et al.
2011/0069499 A1 3/2011 Trott et al.
2011/0080750 A1 4/2011 Jones et al.
2011/0116276 A1 5/2011 Okamura et al.
2011/0121756 A1 5/2011 Thomas et al.
2011/0134634 A1 6/2011 Gingrich, III et al.
2011/0134651 A1 6/2011 Berman
2011/0140633 A1 6/2011 Archenhold
2011/0170294 A1 7/2011 Mier-Langner et al.
2011/0194299 A1 * 8/2011 Crooks ..... F21V 21/04
362/427
2011/0216534 A1 9/2011 Tickner et al.
2011/0226919 A1 9/2011 Fryzek et al.
2011/0241557 A1 10/2011 Grotkowski et al.
2011/0255292 A1 10/2011 Shen
2011/0267828 A1 11/2011 Bazydola et al.
2011/0285314 A1 11/2011 Carney et al.
2012/0020104 A1 1/2012 Biebl et al.
2012/0074852 A1 3/2012 Delnoij
2012/0106176 A1 5/2012 Lopez et al.
2012/0113642 A1 * 5/2012 Catalano ..... F21S 8/02
362/249.02
2012/0140442 A1 6/2012 Woo et al.
2012/0162994 A1 6/2012 Wasniewski et al.
2012/0182744 A1 7/2012 Santiago et al.
2012/0188762 A1 7/2012 Joung et al.
2012/0243237 A1 9/2012 Toda et al.
2012/0287625 A1 11/2012 Macwan et al.
2012/0305868 A1 12/2012 Callahan et al.
2013/0009552 A1 1/2013 Page
2013/0010476 A1 1/2013 Pickard et al.
2013/0016864 A1 1/2013 Ivey et al.
2013/0033872 A1 2/2013 Randolph et al.
2013/0051012 A1 2/2013 Oehle et al.
2013/0141913 A1 6/2013 Sachsenweger
2013/0155681 A1 6/2013 Nall et al.
2013/0163254 A1 6/2013 Chang et al.
2013/0170232 A1 7/2013 Park et al.

(56) References Cited

U.S. PATENT DOCUMENTS

| | | | | |
|---|---|---|---|---|
| 2013/0170233 | A1 | 7/2013 | Nezu et al. | |
| 2013/0258677 | A1 | 10/2013 | Fryzek et al. | |
| 2013/0265750 | A1 | 10/2013 | Pickard et al. | |
| 2013/0271989 | A1 | 10/2013 | Hussell et al. | |
| 2013/0294084 | A1 | 11/2013 | Kathawate et al. | |
| 2013/0301252 | A1 | 11/2013 | Hussell et al. | |
| 2013/0322062 | A1 | 12/2013 | Danesh | |
| 2013/0322084 | A1 | 12/2013 | Ebisawa | |
| 2013/0335980 | A1 | 12/2013 | Nakasuji et al. | |
| 2014/0036497 | A1 | 2/2014 | Hussell et al. | |
| 2014/0049957 | A1 | 2/2014 | Goelz et al. | |
| 2014/0063776 | A1 | 3/2014 | Clark et al. | |
| 2014/0071679 | A1 | 3/2014 | Booth | |
| 2014/0071687 | A1 | 3/2014 | Tickner et al. | |
| 2014/0140490 | A1 | 5/2014 | Roberts et al. | |
| 2014/0063818 | A1 | 6/2014 | Randolph et al. | |
| 2014/0159616 | A1 | 6/2014 | Wang et al. | |
| 2014/0233246 | A1 | 8/2014 | Lafreniere et al. | |
| 2014/0254177 | A1 | 9/2014 | Danesh | |
| 2014/0265933 | A1 | 9/2014 | Melanson et al. | |
| 2014/0268836 | A1 | 9/2014 | Thompson | |
| 2014/0299730 | A1 | 10/2014 | Green et al. | |
| 2014/0313775 | A1 | 10/2014 | Myers et al. | |
| 2014/0321122 | A1 | 10/2014 | Domagala et al. | |
| 2014/0347848 | A1 | 11/2014 | Pisavadia et al. | |
| 2015/0009676 | A1 | 1/2015 | Danesh | |
| 2015/0029732 | A1 | 1/2015 | Hatch | |
| 2015/0078008 | A1 | 3/2015 | He | |
| 2015/0138779 | A1* | 5/2015 | Livesay | F21S 8/026 362/298 |
| 2015/0184837 | A1* | 7/2015 | Zhang | F21S 8/00 362/294 |
| 2015/0198324 | A1 | 7/2015 | O'Brien et al. | |
| 2015/0219317 | A1 | 8/2015 | Gatof et al. | |
| 2015/0233556 | A1 | 8/2015 | Danesh | |
| 2015/0241039 | A1 | 8/2015 | Fryzek | |
| 2015/0263497 | A1 | 9/2015 | Korcz et al. | |
| 2015/0276185 | A1 | 10/2015 | Bailey et al. | |
| 2015/0308662 | A1 | 10/2015 | Vice et al. | |
| 2015/0345761 | A1 | 12/2015 | Lawlor | |
| 2015/0362159 | A1* | 12/2015 | Ludyjan | F21V 23/06 362/277 |
| 2016/0126860 | A1 | 5/2016 | Summerland | |
| 2016/0209007 | A1 | 7/2016 | Belmonte et al. | |
| 2016/0218626 | A1 | 7/2016 | Del Carmen | |
| 2016/0308342 | A1 | 10/2016 | Witherbee et al. | |
| 2016/0348860 | A1 | 12/2016 | Danesh | |
| 2016/0348861 | A1 | 12/2016 | Bailey et al. | |
| 2016/0366738 | A1 | 12/2016 | Boulanger et al. | |
| 2017/0045213 | A1 | 2/2017 | Williams et al. | |
| 2017/0059135 | A1 | 3/2017 | Jones | |
| 2017/0138576 | A1 | 5/2017 | Peng et al. | |
| 2017/0138581 | A1 | 5/2017 | Doust | |
| 2017/0198896 | A1 | 7/2017 | May | |
| 2017/0307188 | A1* | 10/2017 | Oudina | F21V 21/04 |
| 2018/0142871 | A1* | 5/2018 | Morales | F21V 21/14 |
| 2018/0231197 | A1 | 8/2018 | Danesh | |
| 2018/0372284 | A1 | 12/2018 | Danesh et al. | |
| 2019/0049080 | A1 | 2/2019 | Danesh | |
| 2019/0063701 | A1 | 2/2019 | Lotfi et al. | |
| 2019/0093836 | A1 | 3/2019 | Danesh | |

FOREIGN PATENT DOCUMENTS

| | | | | |
|---|---|---|---|---|
| CA | 2691480 | C | 4/2012 | |
| CA | 2734369 | A1 | 10/2013 | |
| CA | 2561459 | A1 | 11/2013 | |
| CA | 2815067 | | 11/2013 | |
| CA | 2848289 | A1 | 10/2014 | |
| CN | 2182475 | Y | 11/1994 | |
| CN | 201059503 | Y | 5/2008 | |
| CN | 201259125 | Y | 6/2009 | |
| CN | 101608781 | A | 12/2009 | |
| CN | 201636626 | U | 11/2010 | |
| CN | 102062373 | A | 5/2011 | |
| CN | 202014067 | U | 10/2011 | |
| CN | 202392473 | U | 8/2012 | |
| CN | 202733693 | U | 2/2013 | |
| CN | 103307518 | A | 9/2013 | |
| CN | 103322476 | A | 9/2013 | |
| CN | 203215483 | U | 9/2013 | |
| CN | 20327663 | U | 11/2013 | |
| CN | 101498411 | B | 11/2013 | |
| CN | 203297980 | U | 11/2013 | |
| CN | 203628464 | U | 12/2013 | |
| CN | 203641919 | U | 6/2014 | |
| CN | 204300818 | U | 4/2015 | |
| CN | 104654142 | A | 5/2015 | |
| CN | 204513161 | U | 7/2015 | |
| CN | 204611541 | U | 9/2015 | |
| CN | 204786225 | U | 11/2015 | |
| CN | 204829578 | U | 12/2015 | |
| CN | 103712135 | B | 4/2016 | |
| CN | 205606362 | U | 9/2016 | |
| CN | 2016130742 | U | 4/2017 | |
| CN | 103154606 | B | 5/2017 | |
| CN | 206222112 | U | 6/2017 | |
| CN | 107013845 | A | 8/2017 | |
| CN | 107084343 | A | 8/2017 | |
| DE | 9109828 | U1 | 2/1992 | |
| DE | 199 47 208 | | 5/2001 | |
| EP | 1 672 155 | A1 | 6/2006 | |
| EP | 1672155 | A1 | 6/2006 | |
| EP | 2 306 072 | A1 | 4/2011 | |
| EP | 2 453 169 | A2 | 5/2012 | |
| EP | 2 193 309 | B1 | 7/2012 | |
| EP | 2 735 787 | A1 | 5/2014 | |
| EP | 3 104 024 | A1 | 12/2016 | |
| GB | 2427020 | A | 12/2006 | |
| GB | 2509772 | A * | 7/2014 | F21V 25/12 |
| JP | H02113002 | U | 9/1990 | |
| JP | 2007091052 | A | 4/2007 | |
| JP | 2007265961 | A | 10/2007 | |
| JP | 2011060450 | A2 | 3/2011 | |
| JP | 2012064551 | A2 | 3/2012 | |
| JP | 2015002027 | A2 | 1/2015 | |
| JP | 2015002028 | A2 | 1/2015 | |
| JP | 2017107699 | A2 | 6/2017 | |
| KR | 1020110008796 | A | 1/2011 | |
| KR | 1020120061625 | A | 6/2012 | |
| MX | 2011002947 | A | 9/2011 | |
| TW | 474382 | U | 1/2002 | |
| WO | WO 2013/128896 | A1 | 9/2013 | |
| WO | WO 2015/000212 | A1 | 1/2015 | |
| WO | WO 2016152166 | A2 | 8/2016 | |

OTHER PUBLICATIONS

Canadian Office Action, dated Dec. 6, 2016, Canadian Application No. 2,879,629.

CA Office Action (dated Dec. 23, 2013), Application No. 2,778,581, Date Filed Jun. 1, 2012, 3 pages.

Non-Final OfficeAction (dated Oct. 16, 2014), U.S. Appl. No. 13/484,901, dated May 31, 2012, First Named Inventor: Michael D. Danesh, 15 pages.

Final Office Action (dated Apr. 2, 2015), U.S. Appl. No. 13/484,901, filed May 31, 2012, First Named Inventor: Michael D. Danesh, 13 pages.

Non-Final Office Action (dated Jun. 2, 2015), U.S. Appl. No. 12/183,424, filed Feb. 18, 2014, First Named Inventor: Michael D. Danesh. 20 pages.

Non-Final Office Action (dated Jul. 20, 2015), U.S. Appl. No. 14/184,601, filed Feb. 19, 2014, First Named Inventor: Michael D. Danesh, 19 pages.

Non-Final Office Action (dated Sep. 15, 2015), U.S. Appl. No. 13/484,901, filed May 31, 2012. First Named Inventor: Michael D. Danesh, 16.

Final Office Action (dated Jan. 29, 2016), U.S. Appl. No. 14/183,424, filed Feb. 18, 2014, First Named Inventor: Michael D. Danesh, 21.

CA Office Action (dated Feb. 1, 2016), Application No. 2,879,486, Filing Date: Jan. 23, 2015, First Named Inventor: Michael D. Danesh, 5.

(56) References Cited

OTHER PUBLICATIONS

DMF, Inc., "dmfLighting: LED Recessed Lighting Solutions", *Info sheets*, (Mar. 19, 2012), 4 pages.
Halo, Halo LED H7 Collection, SustainabLEDesign, *Cooper Lighting*, (emphasis on p. 18 "H7 Collection LED Modules—Halo LED H7 Module Features"), (Mar. 28, 2012), 52 pages.
Halo, H7 LED Downlight Trims 49x Series, 6-inch LED Trims for Use with ML7x LED Modules, *Cooper Lighting*, ADV110422, (rev. Aug. 12, 2011), 15 pages.
Final Office Action (dated Apr. 27, 2016), U.S. Appl. No. 14/181,601, filed Feb. 19, 2014, First Named Inventor: Michael D. Danesh, 18.
Final Office Action (dated Jun. 23, 2016), U.S. Appl. No. 13/484,901, filed May 31, 2012, First Named Inventor: Michael D. Danesh, 18 pages.
"*DME Series Installation Instructions*", (Oct. 18, 2011).
Acrich COB Zhaga Module, Product Description, Seoul Semiconductor, Nov. 2016, 39 pages.
<https://www.zhagastandard.org/books/book18/>, Mar. 2017, 5 pages.
Notice of Allowance dated May 10, 2018 from U.S. Appl. No. 14/726,064, 7 pages.
2006 International Building Code, Section 712 Penetrations, 2006, 4 pages.
BXUV.GuideInfo, Fire Resistance Ratings—ANSI/UL 263, UL Online Certifications Directory, last updated Nov. 3, 2016, 27 pages.
CEYY.GuideInfo, Outlet Boxes and Fittings Certified for Fire Resistance, UL Online Certifications Directory, last updated May 16, 2013, 2 pages.
Canadian Office Action dated Dec. 23, 2013 from Canadian Application No. 2,778,581, 3 pages.
Canadian Office Action dated Mar. 22, 2016 from Canadian Application No. 2,879,629, 4 pages.
Canadian Office Action dated Mar. 9, 2017 from Canadian Application No. 2,931,588, 5 pages.
Canadian Office Action dated Feb. 1, 2016 from Canadian Application No. 2,879,486, 5 pages.
Canadian Office Action dated Jun. 12, 2017 from Canadian Application No. 2,927,601, 4 pages.
Canadian Office Action dated Aug. 11, 2017 from Canadian Application No. 2,941,051, 4 pages.
DMF, Inc., "dmfLIGHTING: LED Recessed Lighting Solutions," Info sheets, Mar. 15, 2012, 4 pages.
DMF, Inc., "dmfLIGHTING: LED Recessed Downlighting," DRD2 Product Brochure, Oct. 23, 2014, 50 pages.
DMF, Inc., "dmfLIGHTING: LED Recessed Downlighting," Product Catalog, Aug. 2012, 68 pages.
Final Office Action dated Jul. 26, 2017 from U.S. Appl. U.S. Appl. No. 14/184,601, 18 pages.
Final Office Action dated Jan. 29, 2016 from U.S. Appl. No. 14/183,424, 21 pages.
Final Office Action dated Apr. 2, 2015 from U.S. Appl. No. 13/484,901, 13 pages.
Halo, Halo LED H4 H7 Collection, SustainabLEDesign, Cooper Lighting, (emphasis on p. 18 "H7 Collection LED Modules—Halo LED H7 Module Features,") Mar. 28, 2012, 52 pages.
Halo, H7 LED Downlight Trims 49x Series, 6-inch LED Trims for Use with MI7x LED Modules, Cooper Lighting, ADV110422, rev. Aug. 12, 2011, 15 pages.
Halo, LED Module ML706x, Cooper Lighting, General Installation for All Modules/p. 1; Tether Installation/pp. 2-3; Installation into Halo H750x Series LED—only (Non-Screw Based), Recessed Fixture, p. 4, Oct. 20, 2009, 4 pages.
"Membrane Penetrations in Fire-Resistance Rated Walls," https://www.ul.com/wp-content/uploads/2014/04/ul_MembranePenetrations.pdf, Issue 1, 2009, 2 pages.
"Metallic Outlet Boxes," UL 514A, Underwriters Laboratories, Inc., Feb. 16, 2004 (Title Page Reprinted Aug. 10, 2007), 106 pages.
"Metallic and Non-metallic Outlet Boxes Used in Fire-rated Assembly," https://iaeimagazine.org/magazine/2000/09/16/metallic-and-non-metallic-outlet-boxes-used-in-fire-rated-assembly/, Sep. 16, 2000, 5 pages.
Notice of Allowance dated Mar. 26, 2018 for U.S. Appl. No. 14/184,601, 10 pages.
Non-Final Office Action dated Mar. 15, 2010 from U.S. Appl. No. 12/100,148, 8 pages.
Non-Final Office Action dated Apr. 30, 2010 from U.S. Appl. No. 12/173,232, 13 pages.
Non-Final Office Action dated Sep. 5, 2014 from U.S. Appl. No. 13/791,087, 8 pages.
Non-Final Office Action dated Jul. 20, 2015 from U.S. Appl. No. 14/184,601, 16 pages.
Non-Final Office Action dated Feb. 6, 2018 from U.S. Appl. No. 15/167,682, 9 pages.
Non-Final Office Action dated Sep. 15, 2015 from U.S. Appl. No. 13/484,901, 16 pages.
Non-Final Office Action dated Oct. 16, 2014 from U.S. Appl. No. 13/484,901, 11 pages.
Non-Final Office Action dated Sep. 6, 2017 from U.S. Appl. No. 14/726,064, 8 pages.
Non-Final Office Action dated May 17, 2017 from U.S. Appl. No. 14/183,424, 20 pages.
Non-Final Office Action dated Jun. 2, 2015 from U.S. Appl. No. 14/183,424, 20 pages.
Non-Final Office Action dated Apr. 12, 2018 for U.S. Appl. No. 29/638,259, 5 pages.
Notice of Allowance dated Jan. 30, 2015 from U.S. Appl. No. 13/791,087, 9 pages.
Notice of Allowance dated Jan. 16, 2015 from U.S. Appl. No. 29/467,026, 9 pages.
Notice of Allowance dated Oct. 21, 2016 from U.S. Appl. No. 13/484,901, 7 pages.
Notice of Allowance dated Mar. 24, 2016 from U.S. Appl. No. 14/247,149, 8 pages.
Notice of Allowance dated Aug. 23, 2017 from Canadian Application No. 2,879,629, 1 page.
"Outlet Boxes for Use in Fire Rated Assemblies," https://www.ul.com/wp-content/uploads/2014/04/UI_outletboxes.pdf, 2011, 2 pages.
U.S. Appl. No. 29,664,471, filed Sep. 25, 2018, Danesh et al.
U.S. Appl. No. 29/653,142, filed Jun. 11, 2018, Danesh et al.
"Advanced LED Solutions," lmtra Marine Lighting. 2011. 39 pages.
"Cree LMH2 LED Module with TrueWhite Technology," Cree Product Family Data Sheet. 2011. 3 pages.
"Cree LMH2 LED Modules Design Guide," Cree Product Design Guide. 2011. 20 pages.
"Cree LMH2 LED Modules," Mouser Electronics. 2 pages.
"LED Undercabinet Pocket Guide," ELCO Lighting.12 pages.
"Portland Bi-Color, Warm White/Red," item:ILIM30941.Imtra Marine Products. 2012. 3 pages.
"Undercabinet Pucks, Xyris Mini LED Puck Light," ELCO Lighting. Sep. 2018. 1 page.
"VERSI LED Mini Flush," Lithonia Lghting. 6 pages.
Cree LED Lamp Family Sales Sheet—Better light is beautiful light , Apr. 24, 2017, 2 pages.
Non-Final Office Action dated Jun. 25, 2018 for U.S. Appl. No. 29/541,565, 10 pages.
Non-Final Office Action dated Oct. 24, 2018 for U.S. Appl. No. 15/688,266, 14 pages.
Notice of Allowance dated May 22, 2018 from U.S. Appl. No. 14/183,424, 9 pages.
Notice of Allowance dated Oct. 4, 2018 from U.S. Appl. No. 15/947,065 , 9 pages.
Notice of Allowance dated Oct. 9, 2018 from U.S. Appl. No. 29/653,142, 7 pages.
Notice of Allowance dated Sep. 19, 2018 from U.S. Appl. No. 15/167,682 , 7 pages.
Notice of Allowance dated Sep. 21, 2018 from U.S. Appl. No. 29/645,941, 5 pages.
OneFrame Recessed LED Downlight. Dmflighting.com. Published Jun. 6, 2018. Retrieved at https://www.dmflighting.com/product/oneframe on Jun. 6, 2018. 11 pages.
U.S. Appl. No. 16/016,040, filed Jun. 22, 2018, Danesh.
U.S. Appl. No. 16/200,393, filed Nov. 26, 2018, Danesh.
U.S. Appl. No. 29/678,478, filed Jan. 29, 2019, Danesh et al.
U.S. Appl. No. 29,678,482, filed Jan. 29, 2019, Danesh et al.

(56) References Cited

OTHER PUBLICATIONS

Civil Action No. 2:18-cv-07090. Complaint for Infringement and Unfair Competition. *DMF, Inc.* v. *AMP Plus, Inc. d/b/a Elco Lighting*. 52 pages. Dated Aug. 15, 2018.
International Search Report and Written Opinion in International Patent Application No. PCT/US18/39048 dated Dec. 14, 2018. 24 pages.
International Search Report and Written Opinion in PCT/US2018/048357 dated Nov. 14, 2018, 13 pages.
Non-Final Office Action dated Dec. 5, 2018 from U.S. Appl. No. 14/942,937, 13 pages.
Non-Final Office Action dated Feb. 7, 2019 from U.S. Appl. No. 16/200,393, 32 pages.
Non-Final Office Action dated Jul. 24, 2018 from U.S. Appl. No. 29/638,259, 5 pages.
Notice of Allowance dated Feb. 8, 2019 from U.S. Appl. No. 29,541,565, 5 pages.
Notice of Allowance dated Jan. 2, 2019 from U.S. Appl. No. 29,541,565, 6 pages.
Notice of Allowance dated Jan. 28, 2019 from U.S. Appl. No. 29/664,471, 8 pages.
Notice of Allowance dated Nov. 27, 2018 from U.S. Appl. No. 15/167,682, 11 pages.
RACO 4 in. Octagon Welded Concrete Ring, 3½ in. Deep with ½ and ¾ in. Knockouts and ilcludes 890 cover (20-Pack). Model # 280. Accessed at https://www.homedepot.com/p/RACO-4-in-Octagon-Welded-Concrete-Ring-3-1-2-in-Deep-with-1-2-and-3-4-in-Knockouts-and-ilcludes-890-cover-20-Pack-280/203638679 on Jan. 18, 2019. 3 pages.
RACO 4 in. Octagon Welded Concrete Ring, 6 in. Deep with ½ and ¾ in. Knockouts (10-Pack). Model # 276. Accessed at https://www.homedepot.com/p/RACO-4-in-Octagon-Welded-Concrete-Ring-6-in-Deep-with-1-2-and-3-4-in-Knockouts-10-Pack-276/203638675 on Jan. 16, 2019. 4 pages.
International Search Report and Written Opinion in International Patent Application No. PCT/US18/62868 dated Mar. 14, 2019, 13 pages.
CS&E PCT Collaborative Search and Examination Pilot Upload Peer Contribution in International Patent Application No. PCT/US18/62868 dated Mar. 14, 2019, 61 pages.
Notice of Allowance dated Apr. 1, 2019 from U.S. Appl. No. 15/167,682, 7 pages.
Non-Final Office Action dated Apr. 4, 2019 from U.S. Appl. No. 29/678,482, 8 pages.
Notice of Allowance dated Apr. 8, 2019 from U.S. Appl. No. 29/653,142, 8 pages.
Notice of Allowance dated Apr. 17, 2019 from U.S. Appl. No. 29/678,478, 7 pages.
International Search Report and Written Opinion in International Patent Application No. PCT/US18/67614 dated Apr. 25, 2019, 20 pages.
CS&E PCT Collaborative Search and Examination Pilot Upload Peer Contribution in International Patent Application No. PCT/US18/67614 dated Apr. 24, 2019, 53 pages.
Specification & Features 4" Octagonal Concrete Box Covers. Orbit Industries, Inc. Accessed at https://www.orbitelectric.com on May 6, 2019. 1 page.
4" Octagon Concrete Boxes and Back Plates. Appleton. Accessed at www.appletonelec.com on May 6, 2019. 1 page.
RACO Commercial, Industrial and Residential Electrical Products. Hubbell. Accessed at www.Hubbell-RTB.com on May 6, 2019. 356 pages.
Imtra Marine Lighting 2008 Catalog. 40 pages.
Imtra Marine Lighting 2009 Catalog. 32 pages.
Imtra Marine Lighting Spring 2007 Catalog. 36 pages.
Final Office Action dated Jun. 6, 2019 from U.S. Appl. No. 15/688,266, 7 pages.
Non-Final Office Action dated Jun. 11, 2019 from U.S. Appl. No. 15/901,738, 6 pages.
Notice of Allowance dated Jun. 12, 2019 from U.S. Appl. No. 16/016,040, 8 pages.
Cooper Lighting HALO ML56 LED System Product Sheet. Mar. 2, 2015. Accessed at http://www.cooperindustries.com/content/dam/public/lighting/products/documents/halo/spec_sheets/halo-ml56600-80cri-141689-sss.pdf. 8 pages.
Kwikbrace® New Construction Braces for Lighting Fixtures or Ceiling Fans 1½ in. Depth. Hubbel. Accessed at https://hubbellcdn.com/specsheet/926.pdf on Jun. 27, 2019. 1 page.
IC1JB Housing 4'IC-Rated New Construction Junction Box Housing. AcuityBrands. Accessed at https://www.acuitybrands.com/en/products/detail/845886/juno/ic1jb-housing/4-ic-rated-new-construction-junction-box-housing on Jun. 27, 2019.
Ex-Parte Quayle Action dated Jun. 27, 2019 from U.S. Appl. No. 29/683,730, 5 pages.
Notice of Allowance dated Jul. 31, 2019 from U.S. Appl. No. 15/167,682 , 7 pages.
Supplemenatal Notice of Allowance dated Aug. 5, 2019 from U.S. Appl. No. 15/947,065, 2 pages.
International Search Report and Written Opinion in International Patent Application No. PCT/US19/32281 dated Aug. 2, 2019, 18 pages.

* cited by examiner

OUTER CASING FOR A RECESSED LIGHTING FIXTURE

This application claims the benefit of the earlier filing date of U.S. Provisional Patent Application No. 62/151,308, filed Apr. 22, 2015.

FIELD

An embodiment of the invention relates to an outer casing for a recessed lighting fixture that houses a unified light source module and driver, and that is directly attached to a set of hangar bars without the use of a horizontally oriented frame. Other embodiments are also described.

BACKGROUND

Recessed lighting fixtures are typically installed or mounted into an opening in a ceiling or a wall. Modern recessed lighting fixtures generally consist of a trim, a light source module, a driver circuit, a legacy incandescent "can" in which the light source module and driver circuit are housed, a junction box, and a set of hangar bars to which a horizontally oriented frame or platform is directly attached. The can and junction box are attached to the horizontally oriented platform. The combination of the can and junction box attached to the horizontal platform is bulky and expensive to manufacture. Moreover, the can and the junction box once attached to the platform cannot be adjusted vertically or horizontally.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the total number of figures, a given figure may be used to illustrate the features of more than one embodiment of the invention, and not all elements in the figure may be required for a given embodiment.

DETAILED DESCRIPTION

Several embodiments are described with reference to the appended drawings. While numerous details are set forth, it is understood that some embodiments of the invention may be practiced without these details. In other instances, well-known circuits, structures, and techniques have not been shown in detail so as not to obscure the understanding of this description.

Figure 1:
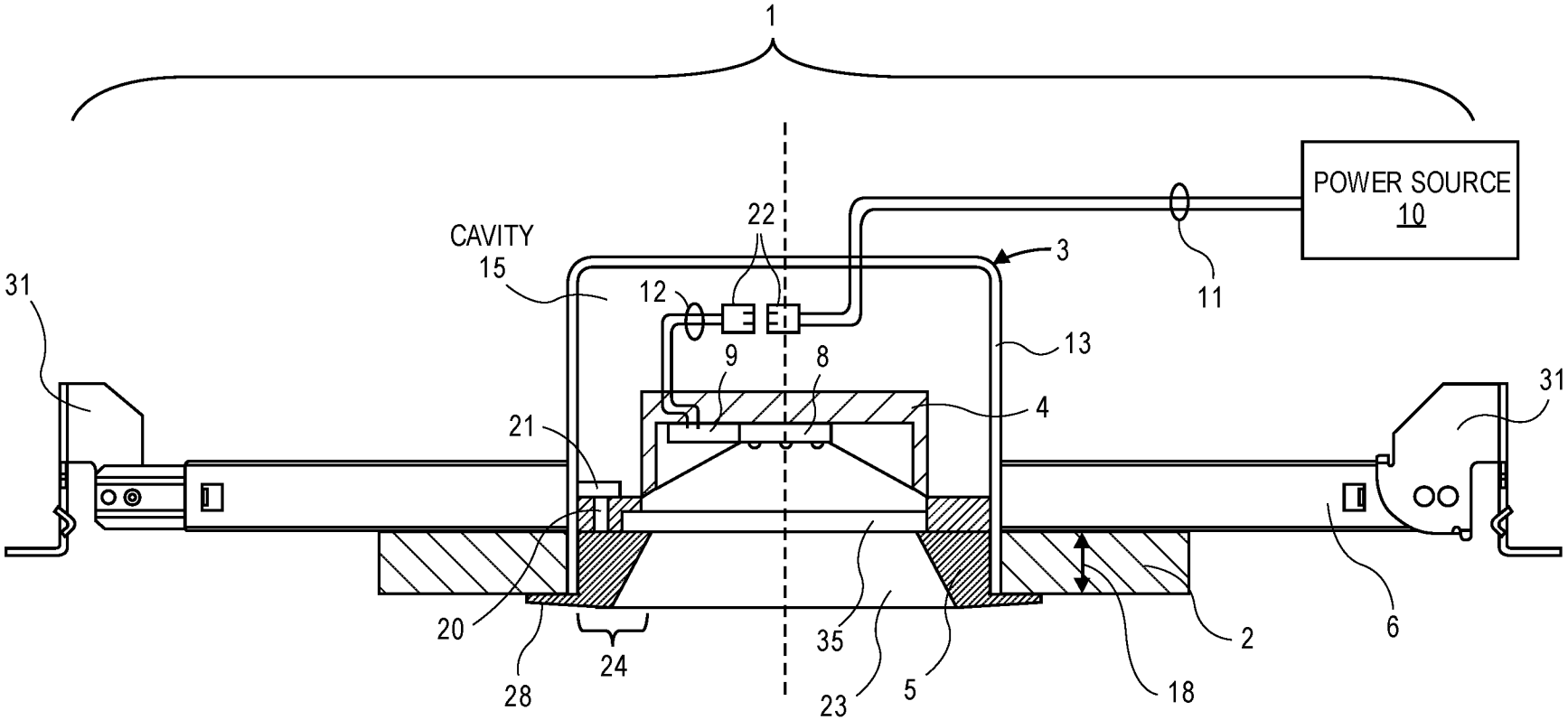
FIG. 1 shows a front cross-section view of an outer casing, with a unified casting positioned inside the outer casing, coupled to hangar bars according to one embodiment.

FIG. 1 shows a cross-section view of a recessed lighting fixture or system 1 installed so that the exposed edge of the ceiling or wall 2, where a hole is formed, is covered. The recessed lighting fixture 1 may include an outer casing 3, a unified casting 4, a trim 5, a set of hangar bars 6, and a set of hangar holders 7 (shown in a side view in FIG. 2 and also in FIG. 4). The unified casting 4 may house both a light source module 8 (e.g. a module of several LED elements) and a driver 9 in a single compact unit. The trim 5 serves the primary purpose of covering the exposed edge of the ceiling or wall where a hole is formed in which the recessed lighting fixture 1 resides while still allowing light from a light source module 8 to be emitted into a room through an aperture 23 of the trim 5 to illuminate the room. In doing so, the trim 5 helps the recessed lighting fixture 1 appear seamlessly integrated into the ceiling or wall. The trim 5 may be attached to the outer casing 3 also to hide at least the periphery at the bottom edge of the outer casing 3 from view. This can be seen in FIG. 1 where a flange 28 extends outward from a trim base 24 so as to hide from view (below the light fixture) the bottom edge of the casing 3. As will be described in further detail below, the recessed lighting fixture 1 provides a more compact and cost effective design that also allows the outer casing 3 to be moved so that its position relative to the hangar bars 6 can be adjusted, while complying with various building and safety codes/regulations. Each of the elements of the recessed lighting fixture 1 will be explained by way of example below.

Instead of using a junction box that is mounted along with a can to a horizontal platform (which is in turn attached to a joist or other structural member behind the ceiling or wall 2), as is already known in the art, the outer casing 3 may be used in such a way that obviates the need for a separate junction box and that also eliminates the horizontal platform. As seen FIG. 2 and in FIG. 3, the outer casing 3, and in particular its sidewall 13, is directly attached to a hangar bar 6 via a hangar holder 7. The hangar bar 6 is in turn attached directly to a joist, beam, or other structural member behind the ceiling or wall 2 at a mounting block 31*a*, 31*b*, so that the aperture 23 of the trim 5 will be aligned with and covers the hole in the wall 2. The outer casing 3 may serve as both a protective barrier between wall insulation materials and wiring junctions inside its cavity, and as a luminaire enclosure. As shown in FIG. 1, the outer casing 3 is a structure that separates the inner components of the recessed lighting fixture 1, i.e., those that are located inside the outer casing 3, including electrical wires/cables 11, 12 and connectors 22 that electrically connect a driver 9 in the unified casting 4 to an external power source 10, from items such as thermal/heat insulation materials and the power source 10 that are outside of the outer casing 3 and inside a ceiling or crawl space in which the outer casing has been installed. In one embodiment, the outer casing 3 may accommodate a wall thickness 18 of the ceiling or wall 2 of ½ inch to 2½ inches. The outer casing 3 may have a fire rating of up to two hours without any need for modification, where the fire rating is described in the National Electrical Code (NEC) and by the Underwriters Laboratories (UL) such as specified in UL 263. The outer casing 3 may receive electrical wires 11 into its cavity from the power source 10, such as an electrical power distribution system (e.g., 120 VAC or 277 VAC) within a building or structure in which the recessed lighting fixture 1 is installed. There may be one or more wire connectors 22 inside the outer casing 3 that join one or more wires 11 which carry 120/277 VAC power and that extend into the casing, to deliver 120/277 VAC power from a circuit breaker or wall switch to the driver 9. The electrical wires 11 from the power source 10 may thus be connected inside the outer casing 3 to corresponding wires 12 of the driver 9 which is inside the unified casting 4, as will be described in greater detail below.

Figure 4:
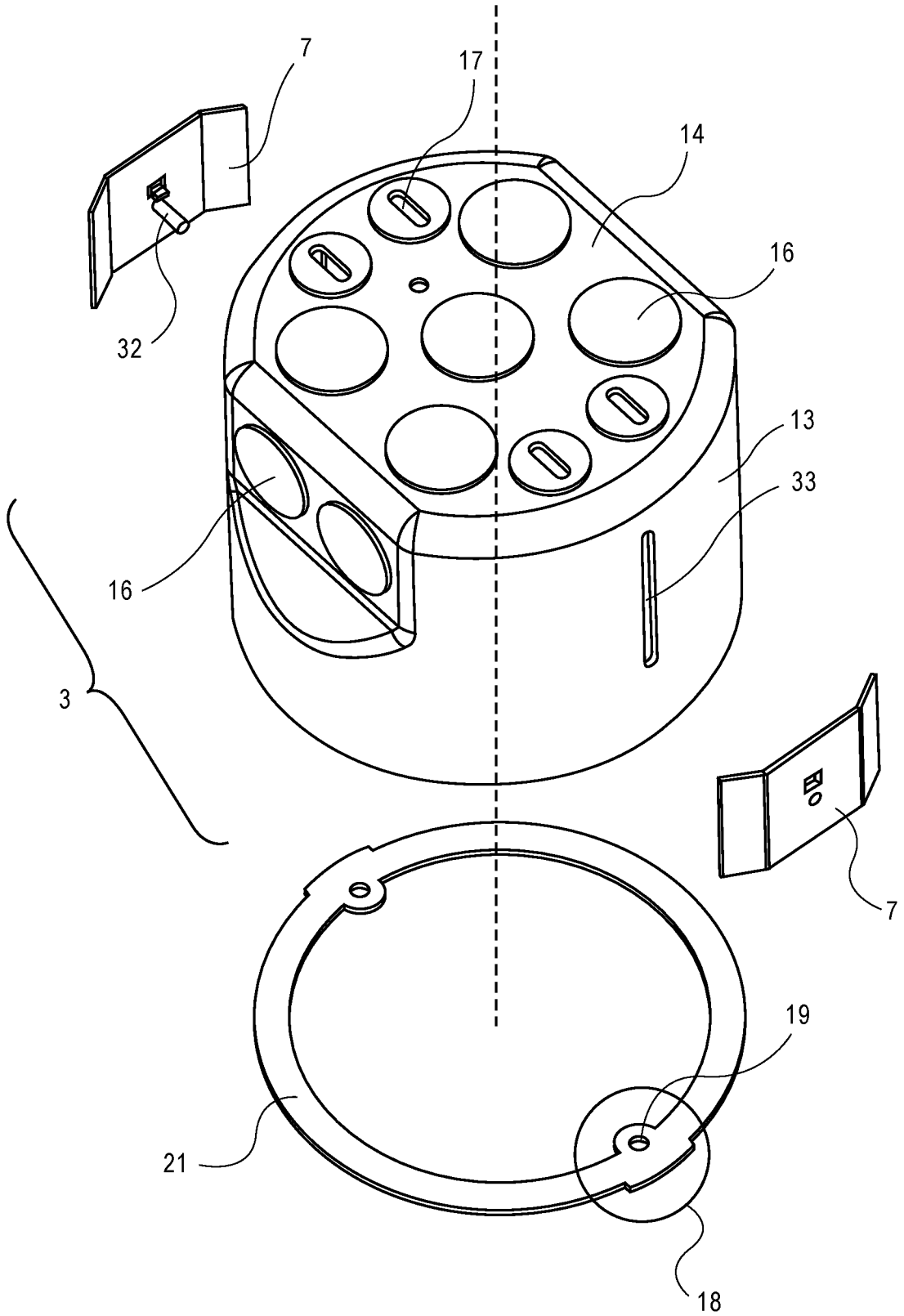
FIG. 4 shows an overhead perspective view of an outer casing, hangar holders, and a ring according to one embodiment.
Figure 5:
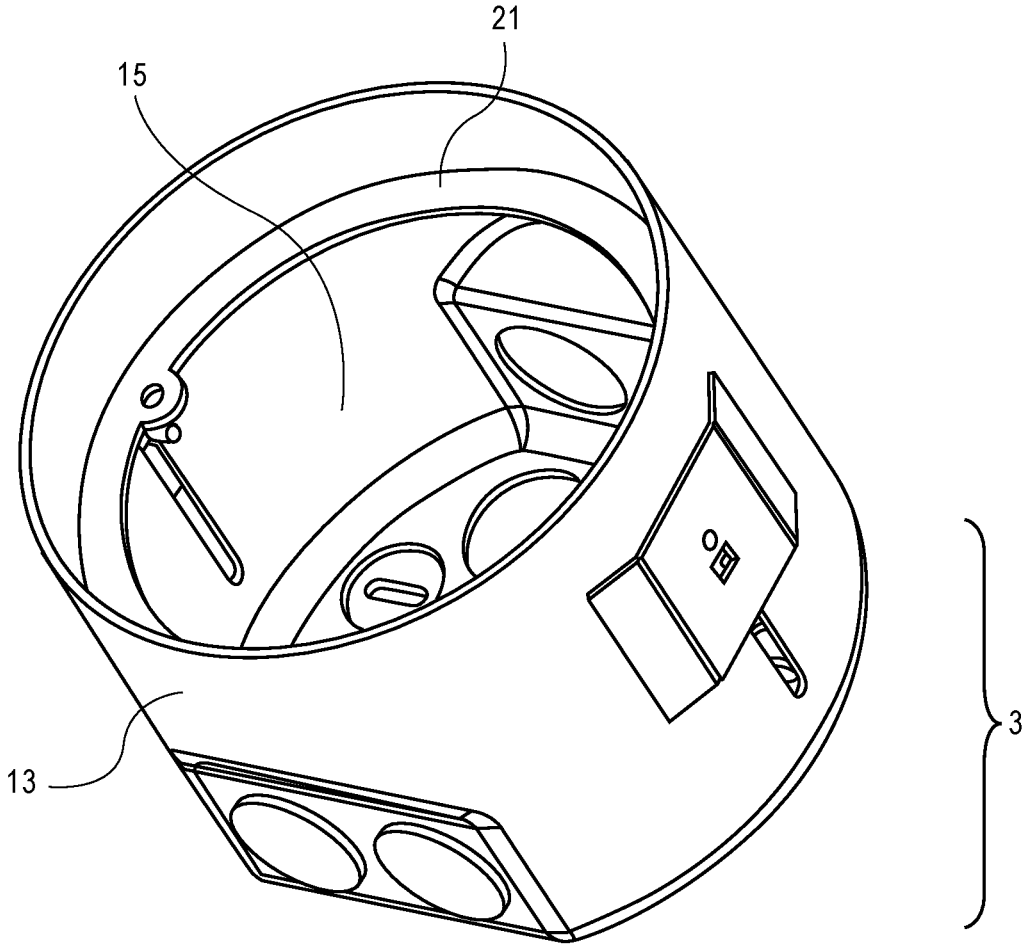
FIG. 5 shows an underneath perspective view of the embodiment of FIG. 4 with the ring inserted into the cavity of the outer casing.

As shown in FIG. 4, the outer casing 3 may have a side wall 13 that extends from and is joined at its upper edge (or upper end) to a closed base end 14, which together define a cavity 15 therein (see FIG. 1 and FIG. 5). The side wall 13 may surround the cavity 15, with its lower edge (or lower end) defining the perimeter of an opening through which various components can be placed inside the cavity 15, including for example, a ring 21, the unified casting 4, and the trim 5, as shown in FIG. 4, FIG. 5, and in FIG. 1. In one embodiment, as shown in FIG. 5, the lower edge (lower end) of the sidewall 13 is devoid of any tabs that extend inward (towards a center vertical axis that is shown as a dotted line). While the side wall 13 is depicted in the relevant figures here as being cylindrical, in other embodiments the side wall 13 of the outer casing 3 have any suitable shape, including a polyhedron, ellipsoid, frusto-conical, or otherwise curved. The cavity 15 that is formed in the outer casing 3 is larger than the outside dimensions of the unified casting 4 such that the entirety of the unified casting 4 fits into the cavity 15—see the front and side views in FIG. 1 and FIG. 2. The unified casting 4 may or may not come into direct contact with the side wall 13 of the outer casing 3. The outer casing 3 is less than 5 inches in height between its base end and the other end of its sidewall.

As seen in FIG. 4, the outer casing 3 may have on its base end 14 one or more knockouts 16 as shown. The knockouts 16 may be punched through and removed to leave an opening behind on the base end 14, for electrical wires 11 or 12 to be inserted through the opening (which wires serve to deliver power to the driver 9). As shown in the top view of FIG. 3, one or more knockouts 16 may also have smaller openings 17 in them (e.g., a slit, slot, etc., that is smaller than the opening that results when the knockout 16 has been removed from the base end 14) that may allow the electrical wires 11 or 12 to be inserted through without the need to punch through the knockouts 16. The knockout 16 may be more than ½ inch in diameter. In one embodiment, one or more of the knockouts 16 allow for the installation therethrough of a non-metallic sheathed cable (as the wires 11). As shown in FIG. 4, one or more of the knockouts 16 may also be positioned on the side wall 13 of the outer casing 3.

In one embodiment, as shown in FIG. 1, the electrical wires 11 received by the outer casing 3 from a power source 10 (e.g. the electrical system of a building or structure) may be connected to the electrical wires 12 of the unified casting 4. As shown, the electrical wires 11 and 12 are connected together through the use of connectors 22 that may be contained within the outer casing 3 (together with the unified casting 4). The term "connector" here is used broadly to not just interlocking or mating connector pairs but also cover wire terminal blocks and wire caps or other devices. In one embodiment, the connectors 22 may be kept outside the outer casing 3 (while the unified casting 4 is retained inside) if the wires 12 are long enough to reach outside of the casing 3. The electrical wires 12 of the unified casting 4 may terminate in a connection with the driver 9 installed within the unified casting 4. When the wires 11 and 12 are connected to each other, electricity may pass from the power source 10 to the driver 9 to enable the driver 9 to power the light source module 8. In one embodiment, the driver 8 has three or more current carrying electrical wires 12.

Figure 6:
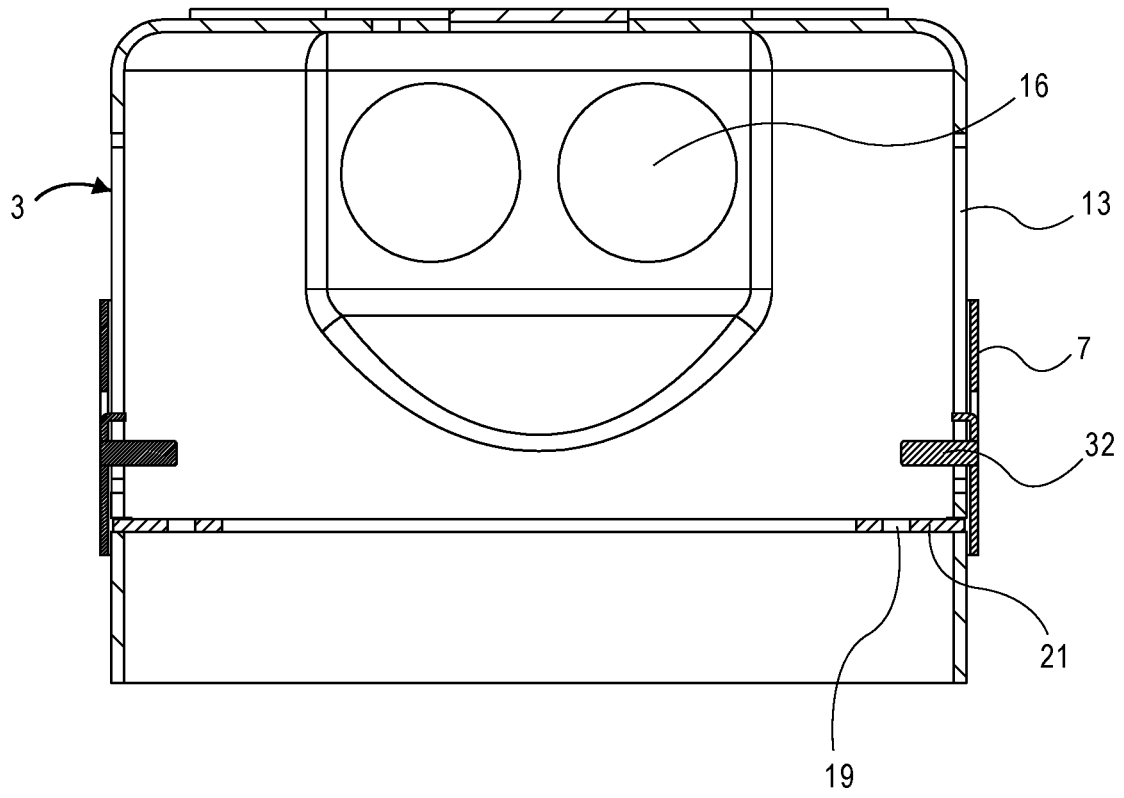
FIG. 6 shows a side cross-section view of an outer casing with hangar holders and a ring according to one embodiment.
Figure 7:
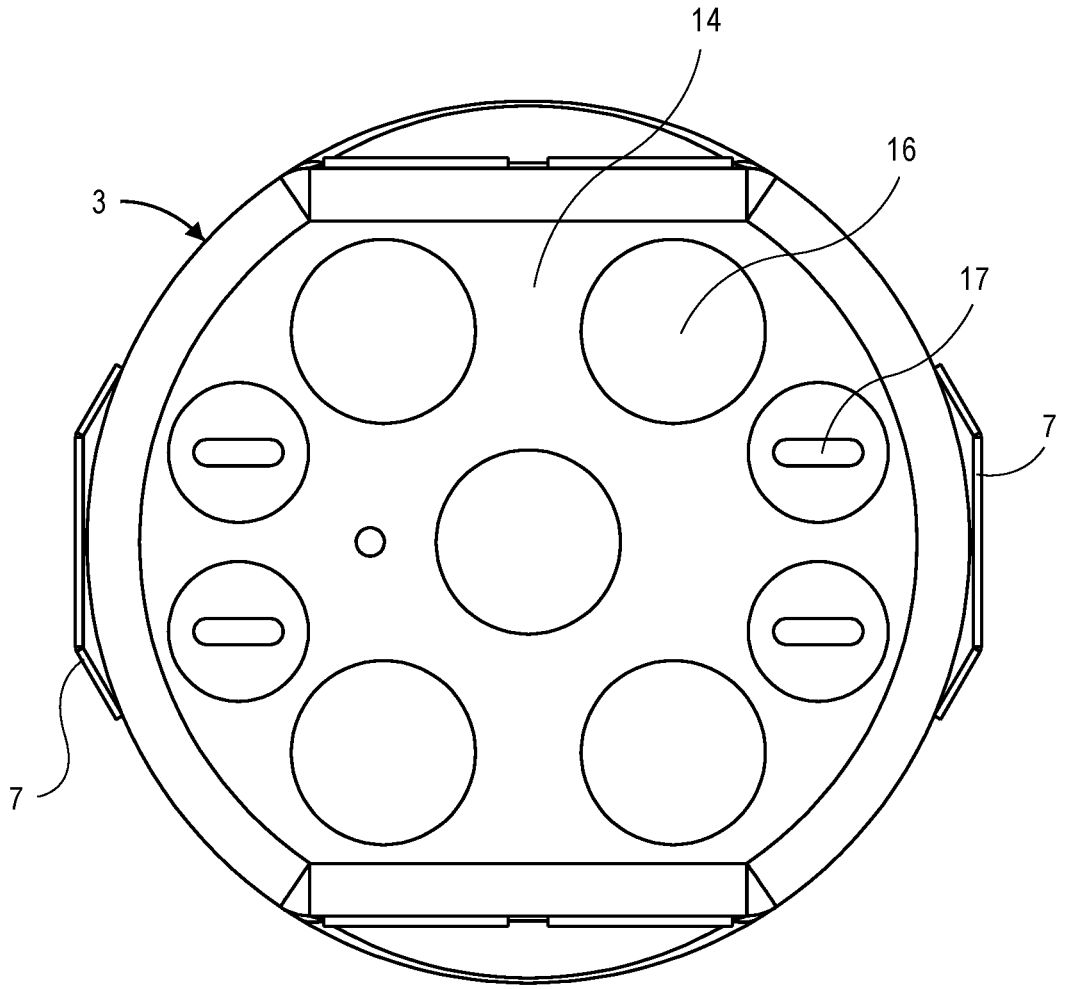
FIG. 7 shows a top view of the embodiment of FIG. 6.

As seen in FIG. 5, the outer casing 3 may have within its cavity 15 a ring 21. The ring 21 maybe shaped as a circle (shown), a polygon, or an ellipsoid, where it conforms to the sidewall 13 of outer casing 3. The ring 21 may be inserted into the cavity 15 of the outer casing 3 through the open end of the side wall 13, and then secured to the inner surface of the side wall 13 of the outer casing 3 as seen in FIG. 6. Once the ring 21 has been secured, the unified casting 4 may be inserted into the cavity 21 (through the same open end of the side wall 13) and then attached to the ring 21 so as to secure the unified casting 4 to the outer casing 3 and prevent the unified casting 4 from falling out of the outer casing. The ring 21 has one or more tabs 18 formed as a flat segment of the ring, each having an opening 19 that passes through the ring 21 (from one face to the other face)—see FIG. 4 and FIG. 6. These are used for coupling (fastening) the outer casing 3 to the unified casting 4—see FIG. 1. In the embodiment of FIG. 4, there are two tabs 18 located diametrically opposite each other (along the circumference of the ring). When the ring 21 is fitted inside the casing 3 (as seen in FIG. 5), each tab 18 may extend inward from and is perpendicular to an inner surface of the side wall 13 of the outer casing 3. Each tab 18 and its opening 19 serves to receive a fastener 20, so as to firmly hold the weight of the unified casting 4 including the light source module 8 and the driver 9 contained in the unified casting 4. The fastener 20 may be a screw, bolt, pin, or the like. In other embodiments, the tabs 18 may incorporate other types of fastening mechanisms (to fasten the unified casting 4 to the outer casing 3), such as a twist-and-lock friction connection that does not require the use of separate tools or other devices. The ring 21 should be affixed inside the cavity so that its tabs 18 may be further recessed inside the cavity 15, towards the base end 14, so that the unified casting 4 and trim 5 may also be further recessed inside the outer casing 3.

In another embodiment, the tab 18 is formed as a portion of the sidewall 13 that has bee bent inward, without the need for a ring 21. In this embodiment, the ring 21 is not necessary, as long as the unified casting 4 can otherwise be secured to the outer casing 3 via the table 18, so as to be prevented from falling out of the outer casing 3.

Figure 8:
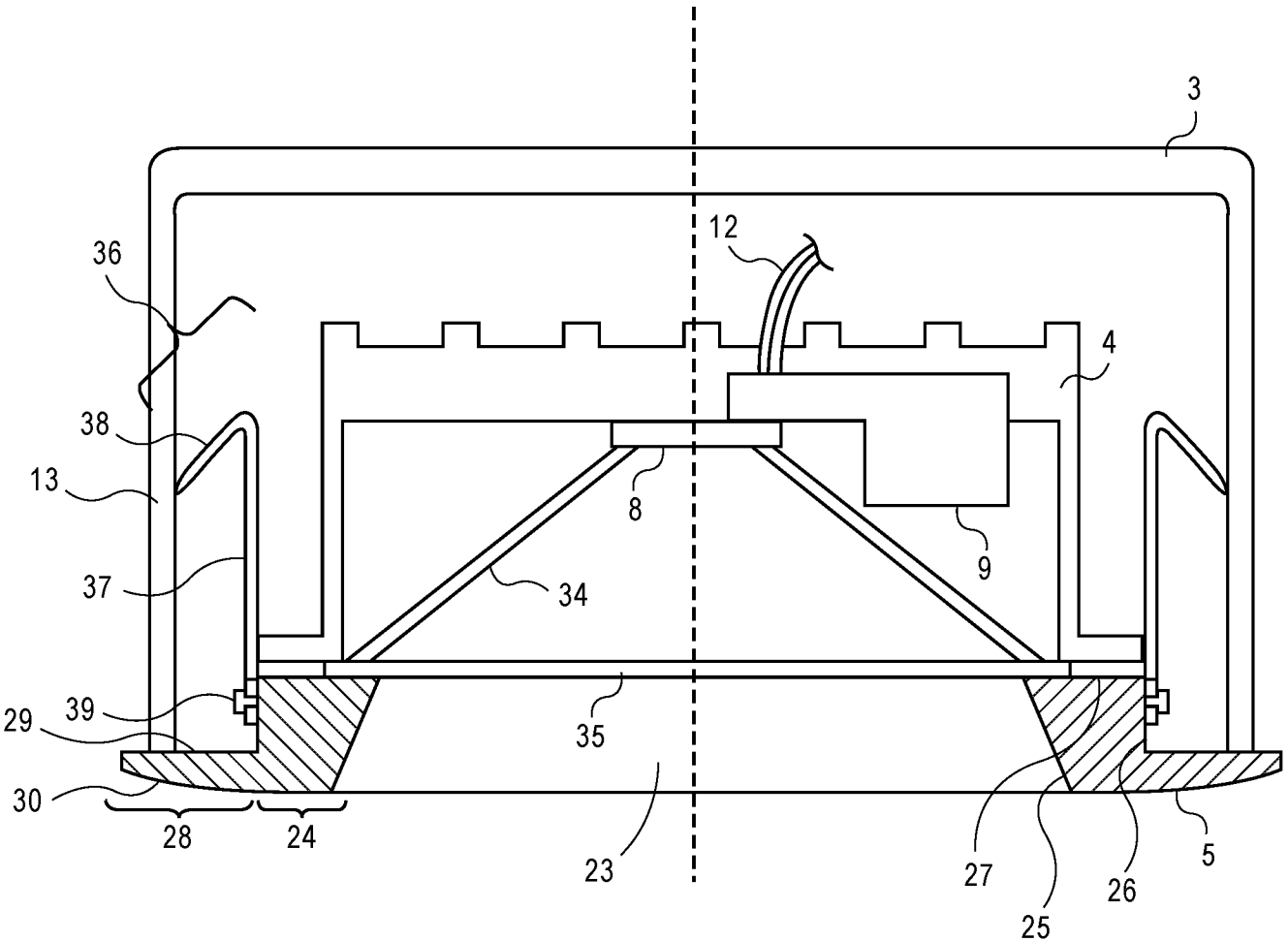
FIG. 8 shows a side cross section view of an outer casing, unified casting, trim, and two friction clips according to one embodiment.

In other embodiments, as shown in FIG. 8, the unified casting 4 may be held inside the outer casing 3, without being directly fastened to any tabs 18. Friction clips 36 (or tension clips) may be utilized to retain the unified casting 4 inside the outer casing 3. Each friction clip 36 may be attached via a screw 39 (or other fastening mechanism such as a bolt, resin, glue, or the like) to a trim base 24 of the trim 5, or directly to the unified casting 4. The friction clip 36 may be flexible and resilient. The friction clip 36 may be a piece of metal that has a straight portion 37 extending from the screw 39 and is then bent backward to form a bent portion 38. The bent portion 38 of the friction clip 36 may directly contact the inner surface of the side wall 13 of the outer casing 3, as shown, preventing the unified casting 4 and the trim 5 from falling out of the outer casing 3.

The unified casting 4 is a shell and/or enclosure that further prevents the exposure of heat from the light source module 8 and the driver 9 to the items inside a ceiling or crawl space (e.g., insulation) in which the recessed lighting fixture 1 has been installed. The unified casting 4 may be formed of metals, polymers, metal alloys, and/or other heat insulating materials. As shown in FIG. 1, the unified casting 4 may be a cylindrical structure; however, in other embodiments, the unified casting 4 may be any suitable shape, including an ellipsoid, cone, or polyhedron that is capable of housing the light source module 8 and the driver 9.

In one embodiment, the unified casting 4 includes one or more heat sinks to dissipate heat generated by the light source module 8 and/or the driver 9. Although the heat sinks are shown as fins (in FIG. 2 and FIG. 8) which are passive components (formed on the outer surface of the end wall and/or the side wall of the unified casting 4) that cool the combined unified casting 4, light source module 8, and driver 9, by dissipating heat into the surrounding air, active heat sinks (e.g., fans) may also be used. In one embodiment, the heat sinks are defined by a set of fins surrounding the unified casting 4, which are formed in the same casting (manufacturing) process that results in the unified casting 4 being formed. The heat sinks may be composed of any thermally conductive material. For example, the heat sinks may be made of aluminium alloys, copper, copper-tungsten pseudoalloy, AlSiC (silicon carbide in aluminium matrix), Dymalloy (diamond in copper-silver alloy matrix), E-Material (beryllium oxide in beryllium matrix), and/or thermally conductive plastics or ceramics.

Still referring to FIG. 8, the recessed lighting fixture 1 may include the driver 9 contained within the unified casting 4. The driver 9 is an electronic circuit or device that supplies and/or regulates electrical energy to the light source module 8 and thus powers the light source module 8 to emit light. The light source module 8 and the driver 9 may be coupled to the end wall of the unified casting 4 as shown in FIG. 8, using any suitable connecting mechanism, including screws, resins, clips, or clamps. The driver 9 may be any type of electrical power supply, including power supplies that deliver an alternating current (AC) or a direct current (DC) voltage to the light source module 8. Upon receiving electricity through the wires 12, the driver 9 may regulate current or voltage to supply a stable voltage or current within the operating parameters of the light source module 8. The driver 9 receives an input current from the power source 10 and may drop the voltage of the input current to an acceptable level for the light source module 8 (e.g., from 120V-277V to 36V-48V). The driver 9 may transfer electrical power to the light source module 8 through an electrical connector (not shown). For example, the driver 9 may deliver electricity to the light source module 8 through an electrical cable (not shown) coupled between the light source module 8 and the driver 9 through removable or permanent connectors or soldered leads originating from the driver 9. The driver 8 may include a magnetic transformer or additional or alternative circuitry for voltage conversion and for regulating the input current or voltage to the light source module 8.

The light source module 8 may be any electro-optical device or combination of devices for emitting light. For example, the light source module 8 may have a single type of light emitting element, as a light emitting diode (LED), organic light-emitting diode (OLED), or polymer light-emitting diode (PLED). In some embodiments, the light source module 8 may have multiple light emitting elements (e.g., LEDs, OLEDs, and/or PLEDs). The light source module 8 receives electricity from the driver 9, as described above, such that the light source module 8 may emit a controlled beam of light into a room or surrounding area. The driver 9 is designed to ensure that the appropriate voltage and current are fed to the light source module 8 to enable the emission of light by the one or more light sources within the light source module 8.

In some embodiments, the recessed lighting fixture 1 may include a reflector 34 contained in the unified casting 4, as shown in FIG. 8. The reflector 34 may surround the entire light source module 8 as shown, or it may surround just a light emitting element of the light source module 8, to adjust the way light emitted by the light source module 8 is directed into a room or surrounding area. In one embodiment, the reflector 34 surrounds the entirety of the light source module 8 and also separates the light source module 8 from the driver 9. This separation allows light from the light source module 8 to be emitted into a room or surrounding area, while shielding the driver 9 from being exposed to the room or surrounding area. For example, in one embodiment, the reflector 34 and the unified casting 4 may together create a sealed structure to shield the driver 9 from the outside environment and the light source module 8. By shielding the driver 9 from the outside environment, the reflector 34 might reduce the risk of fire or other dangers and may help ensure the recessed lighting fixture 1 complies with building and safety codes/regulations. The reflector 34 may be formed of any fire retardant material, including steel, aluminum, metal alloys, calcium silicate, and other similar materials.

The reflector 34 may be formed in any shape that may direct and/or focus light. For example, the reflector 34 may be parabolic or spherical. In one embodiment, the front surface of the reflector 34 may be coated with a reflecting material or include one or more reflecting elements that assists in the adjustment of light emitted by the light source module 8. For example, the reflector 34 may be coated with a shiny enamel or include one or more mirrors or retroreflectors or a microcellular polyethylene terephthalate (MC-PET) material to adjust the focus of light emitted by the light module 8. In other embodiments, the reflector 34 may include various other optic elements to assist in the focusing of light emitted by the light source module 8.

Still referring to FIG. 8, in one embodiment, the recessed lighting fixture 1 may include a lens 35. The lens 35 may be formed to converge or diverge light emitted by the light source module 8. The lens 35 may be a simple lens 35 comprised of a single optical element or a compound lens 35 comprised of an array of simple lenses 35 (elements) with a common axis. In one embodiment, the lens 35 also provides a protective barrier for the light source module 8 and shields the light source module 8 from moisture or inclement weather. The lens 35 may also assist in the diffusion of light and increase the uniformity of light over the surface of the recessed lighting fixture 1. The lens 35 may be made of any at least partially transparent material, including glass and hard plastics. In one embodiment, the lens 35 and the reflector 34 are contained in a single indivisible unit of the unified casting 4, to work in conjunction to focus and adjust light emitted by the light source module 8. In one embodiment, the reflector and the lens are housed together with the driver and the light source module in the unified casting 4 as a single, indivisible unit. In other embodiments, the lens 35 and the reflector 34 may be separate, divisible elements.

Still referring to FIG. 8, in one embodiment, the recessed lighting fixture 1 may include a trim 5. The trim 5 may be attached directly to the unified casting 4 as well as to the outer casing 3 as shown, while in other embodiments the trim 5 is to only be attached to the outer casing 3 (where in that case the unified casting 4 is separately attached to the casing 3, as in FIG. 1 for example). The trim 5 may be attached to the unified casting 4 and/or the outer casing 3 using any suitable connecting mechanism, including resins, clips, screws, bolts, or clamps. In one embodiment, the trim 5 may include grooves and/or slots that are designed to engage with corresponding bumps or tabs of the unified casting 4 and/or the outer casing 3 to form a rotate and lock (or friction lock) connection which prevents axial separation (in FIG. 8, in the vertical or longitudinal direction) of the trim 5 and the outer casing 4, and without the use of separate tools or other devices.

Figure 2:
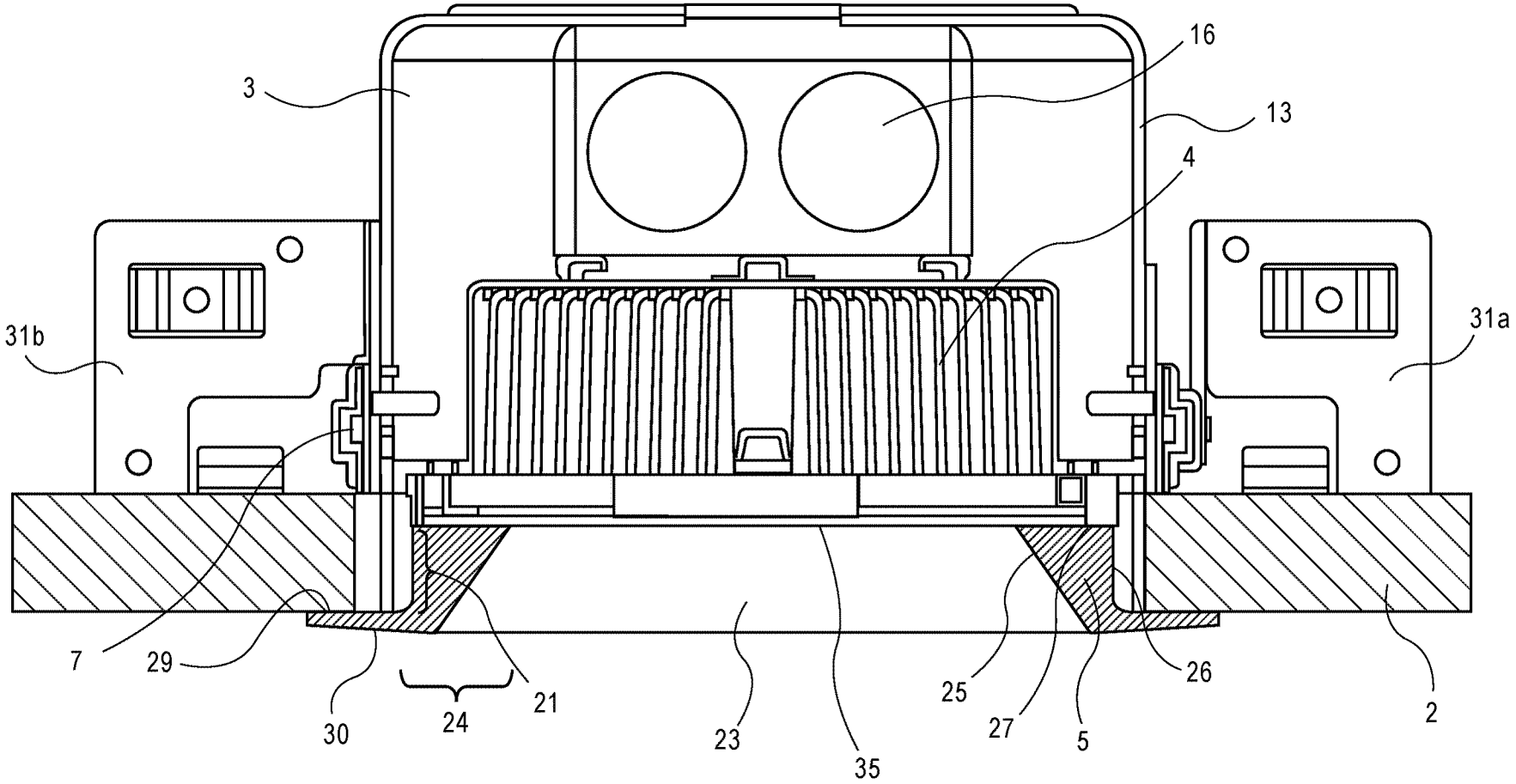
FIG. 2 shows a side cross-section view of the embodiment of FIG. 1.
Figure 3:
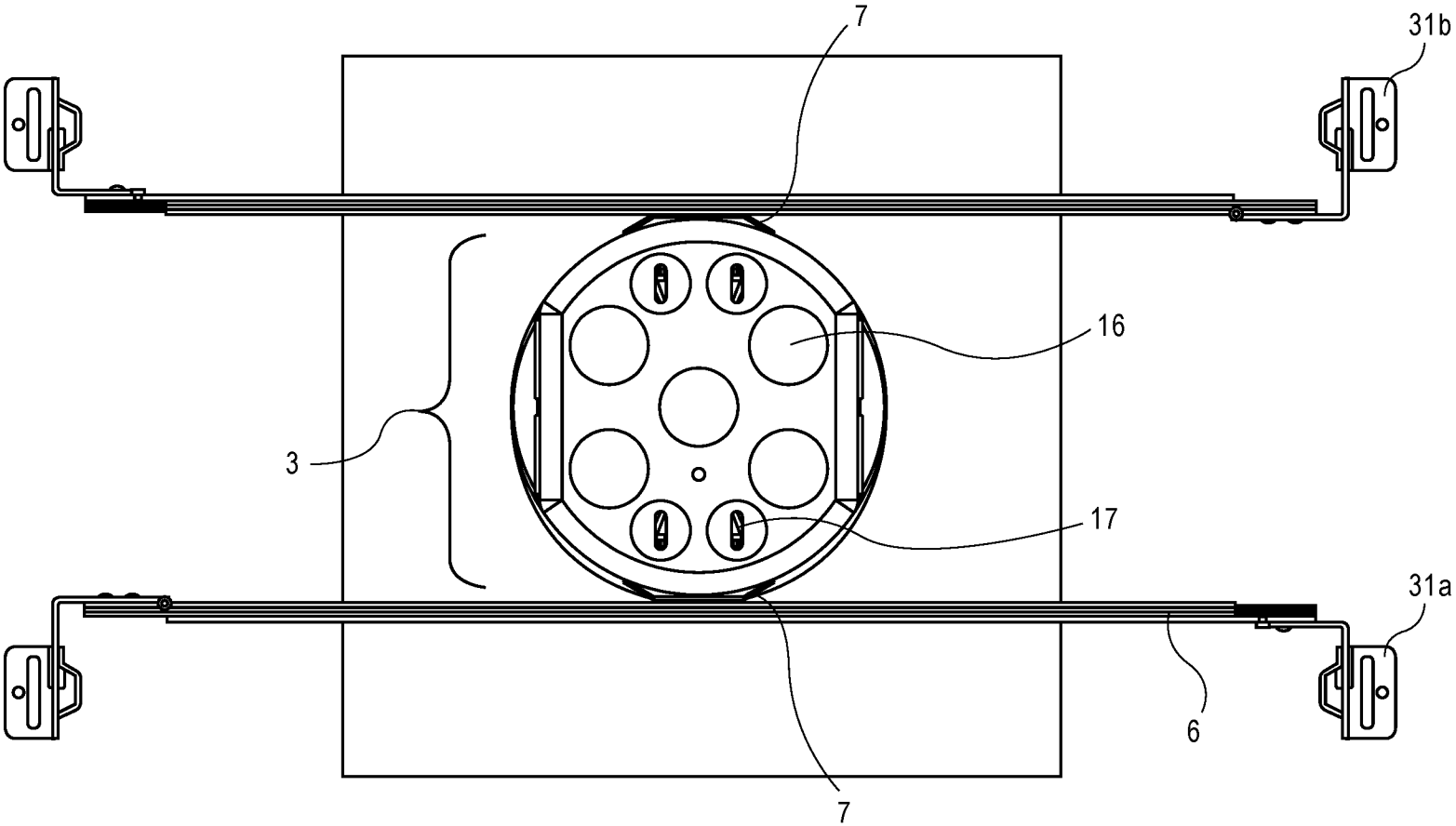
FIG. 3 shows a top view of the embodiment of FIG. 1.

In one embodiment, the entire height 21 of the trim 5, which may or may not be attached to the casting 4, may be inserted into the cavity 15 of the outer casing 3. This is where the unified casting 4 is positioned further (deeper) into the outer casing 3 so that glare from the emitted light is reduced. As seen in FIG. 1 and FIG. 2, for example, the trim 5 may have a trim base 24 (an annular segment) having a height 21, with an inner circumferential surface 25 that is open to the central, light passing aperture 23 and an outer circumferential surface 26 that is closer to the side wall 13 of the outer casing 3. The trim base 24 may have a top surface 27 that extends, in a lateral or horizontal direction, from the inner surface 25 to the outer surface 26 and may be in contact with the lower most surface of the unified casing 4. The height 21 of the trim base 24 may be increased so as to position the lens 35 further into the outer casing 3. It is preferred that the height 21 of the trim base 24 is less than. The trim 5 may have a flange 28 that extends laterally outward from the base 24, with a top surface 29 and a bottom surface 30 as shown. In one embodiment, referring now back to FIG. 1, the trim base 24 may be shaped and sized such that the outer surface 26 thereof conforms to an inner surface of the side wall 13 of the outer casing 3 so that the trim 5 and the outer casing 3 are in direct contact. In one embodiment, the trim 5 may be fitted tightly to the side wall 13 of the outer casing 3 (friction fit) so that the trim 5 does not fall out of the outer casing 3 (when the trim 5 is not also separately attached to the unified casting 4). In another embodiment, the outer surface 26 of the trim base 24 of the trim 5 may be attached to the inner surface of the side wall 13 of the outer casing 3 through any connecting mechanism. The trim 5 may be pushed into the outer casing 3 so that the bottom end or edge of the side wall 13 of the outer casing 3 comes into direct contact with the top surface 29 of the flange 28 of the trim 5, for a tight, snug fit as shown in FIGS. 1 and 2. However, it is not necessary for the end of the side wall 13 of the outer casing 3 to directly contact the top surface 29 of the flange 28 of the trim 5. In yet another embodiment, the outer surface 26 of the trim base 24 need not contact the inner surface of the side wall 13 of the outer casing 3 (e.g., when friction clips 36 are used as shown in FIG. 8).

In one embodiment, different diameter trims 5 may be capable of being coupled to the same unified casting 4 and/or the same outer casing 3, where the diameter is measured at the periphery of the flange 28. The size and design of the trims 5 may depend on the size of the hole the wall 2 in which the recessed lighting fixture 1 has been fitted to conceal the exposed wall or ceiling edge that defines the hole. The recessed lighting system 1 may include two or more trims 5 of different sizes to cover ceiling or wall openings of different sizes. The trim 5 may need to meet the aesthetic demands of the consumer. The trim 5 may be made of aluminum plastic polymers, alloys, copper, copper-tungsten pseudoalloy, AlSiC (silicon carbide in aluminum matrix), Dymalloy (diamond in copper-silver alloy matrix), and E-Material (beryllium oxide in beryllium matrix).

In one embodiment, the recessed lighting fixture 1 may include a set of hangar bars 6 as shown in FIG. 1. The hangar bars 6 may be rigid, elongated members that are connected to adjacent joists and/or beams in the walls or ceilings of a structure. In one embodiment, each of the hangar bars 6 may be telescoping such that each hangar bar 6 may be extended or retracted to meet the gap between the joists and/or beams. In one embodiment, each of the hangar bars 6 may include a set of mounting blocks 31. The mounting blocks 31 may be used to directly attach the hangar bars 6 to the joists and/or beams in the walls or ceilings of a structure. For example, as shown in FIG. 1, the mounting blocks 31 may include holes for receiving screws and/or nails or other fasteners that enable the hangar bars 6 to be securely attached to a building structure. Although shown in FIG. 1 and described above in relation to holes and screws, in other embodiments, other mechanisms of attachment may be used in conjunction with the mounting blocks 31, including resins, clips, or clamps to attached the bars 6 to the building structure. In one embodiment, the mounting blocks 31 may be integrated in one indivisible structure along with the hangar bars 6, while in other embodiments, as shown in FIG. 1, the mounting blocks 31 may be coupled to the hangar bars 6 through the use of one or more attachment mechanisms (e.g., screws, bolts, resins, clips, or clamps). Using the above telescoping and mounting features, the recessed lighting fixture 1 may be installed in almost all the 2"×2" through 2"×18" wood joist constructions, metal stud constructions, and t-bar ceiling constructions.

In one embodiment, referring back to FIG. 3, the recessed lighting fixture 1 may have a mounting mechanism that includes a set of hangar holders 7 (two are shown) that couple the outer casing 3 to the hangar bars 6, respectively. The hangar holder 7 may be a plate that is configured to slide substantially horizontally or otherwise move along the length of a corresponding hangar bar 6 that has a fixed length. Alternatively, the hangar holder 7 may be fixed to a telescoping section of the hangar bar (having a variable length).

FIG. 4 shows a perspective view of the hangar holder 7 according to one embodiment. The hangar holder 7 has an attachment mechanism 32 for coupling with the outer casing 3, so that the outer casing 3 can be coupled to a hangar bar 6, as seen in FIG. 6. The attachment mechanism 32 may be a pin attached to and extending inward from the inner face of the plate of hangar holder 7. The attachment mechanism 32 may be inserted into an elongated opening 33 (e.g. slot, slit, etc.) in the side wall 13 of the outer casing 3. The opening 33 may be vertically or substantially vertically oriented (parallel to the direction of the wall thickness 18, or perpendicular to the longitudinal axis of the hangar bar 6—see FIG. 1) so that when the outer casing 3 is coupled to the hangar holder 7, the outer casing 3 may be moved up or down as desired (while restricted in the sideways or lateral direction due to the attachment mechanism 32 being captured within the elongated opening 33). The outer casing 3 may be moved along the length of the elongated opening 33 before being locked in a particular position. It is preferred that the elevation of the casing 3 behind the ceiling or wall 2 be adjusted in this manner so that the flange 28 of the trim 5 is flush with the ceiling or wall 2 as seen in FIG. 1.

In another embodiment, the attachment mechanism 32 may be a screw that couples the hangar holder 7 to the outer casing 3. When the screw is inserted into the opening 33 of the outer casing 3 and turned, the outer casing 3 may move up or down relative to the hangar bar 6 depending on the direction the screw is turned. Accordingly, the outer casing 3, along with the light source module 8 and the driver 9, may be moved and adjusted so that the flange 28 is flush or sufficiently close to the ceiling or wall during installation. In yet another embodiment, the location of the attachment mechanism 32 and the elongated opening 33 are reversed, so that the opening 33 is formed in the hangar holder 7 rather than in the side wall 13 of the outer casing 3, and the attachment mechanism 32 is affixed to and extending outward from the outside surface of the sidewall 13 of the casing 3.

By being moveably coupled to the hangar holders 7, the outer casing 3, along with the light source module 8 and the driver 9 therein, may be moved in a length direction of the hangar bars 6 to a desired location. The outer casing 3 may also be moved substantially vertically relative to the hangar bars 6. For example, the outer casing 3 may be adjusted vertically more than one inch upwards and one inch downwards. The hangar holders 7 may then be fixed to the hangar bars 6 so that they no longer move substantially horizontally or vertically relative to the hangar bars 6.

As described above, the combination of a hangar bar 6 and a hangar holder 7 allows the outer casing 3 to be moved in a direction parallel to a longitudinal axis of the hangar bar 6, as well as in a direction not parallel (e.g., perpendicular) to the hangar bar 6. Accordingly, the outer casing 3 may be moved to a preferred location between a set of joists or beams in a structure and at a desired height before the being locked into position using the attachment mechanism 32. The unified casting 4 is then positioned inside the outer casing 3, by being inserted into the cavity 15 through the opening defined by the lower end, edge or periphery of the side wall 13. By being configured such that the outer casing 3, along with the light source module 8 and the driver 9 therein, is coupled to a unified set of moveable elements that assist in positioning the combined structure, the recessed lighting fixture 1 eliminates the added bulk and size of traditional recessed lighting fixtures. In particular, the recessed lighting fixture 1 allows adjustment of the position of the light source module 8 between joists or beams, without the need for both a compartment or can that is dedicated to housing the light source module 8 and a separate compartment that is dedicated to housing the driver 9. Instead, the light source module 8 may be housed along with the driver 9 in the same cavity 15 of the outer casing 3, where the latter itself can be directly moved to a desired position. This compact design provides an affordable design by cutting the cost of raw materials and other components and reduces shipping costs by reducing bulk. Also, by having the driver 9 and the light source module 8 placed in the same cavity of the outer casing 3, serviceability and replacement of the driver 9 will be easier to perform and more convenient. In contrast, traditional housings have the driver 9 mounted on the outer casing 3 and contractors are forced to spend a significant amount of time removing parts to gain access to the outer casing 3 and the driver 9.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A recessed lighting fixture comprising:

an outer casing for housing a) a light source module for emitting light and b) a driver for powering the light source module to emit light, wherein the outer casing has a base end joined to one end of a side wall, and an inner surface of the base end and an inner surface of the side wall define a cavity, and wherein the side wall of the outer casing has another end that defines an opening of the cavity;

a trim for covering an opening in a ceiling or a wall behind which the outer casing is installed;

a mounting mechanism to couple the side wall of the outer casing to a hangar bar whose length is adjustable along a first direction, wherein the mounting mechanism allows a position of the outer casing to be adjusted relative to the hangar bar in a second direction substantially perpendicular to the first direction;

a ring having a flat portion and attached to the side wall of the outer casing, the ring having a plurality of holes formed in the flat portion thereof, each hole of the plurality of holes to receive a corresponding fastener for securing a unified casting to the ring, the unified casting housing the driver and the light source module together with a reflector and a lens as a single unit; and a plurality of wire connectors within the outer casing to join a first plurality of wires, which carry electrical power with at least one of 120 VAC or 277 VAC and that extend into the casing to deliver the electrical power from a circuit breaker or wall switch, to a second plurality of wires extending out of the driver, wherein the outer casing serves as both a junction box to house the plurality of wire connectors and a luminaire enclosure, wherein the trim has a) a trim base with an outer surface and b) a flange extending outwardly from the outer surface of the trim base, and wherein when the trim base is positioned inside the cavity of the outer casing the flange lies against a front face of the ceiling or wall behind which the outer casing is installed.

2. The recessed lighting fixture of claim 1, wherein the outer casing has one or more knockouts that are each more than ½ inch in diameter.

3. The recessed lighting fixture of claim 1 further comprising the unified casting.

4. The recessed lighting fixture of claim 3 wherein the outer casing is less than 5 inches in height between the base end and said another end of the side wall.

5. The recessed lighting fixture of claim 3 further comprising a plurality of friction clips each being secured to the trim base at one end and free to contact the side wall of the outer casing at another end, and wherein the trim base is separately attached to the unified casting.

6. The recessed lighting fixture of claim 3 wherein the outer surface of the trim base is in contact with the inner surface of the side wall of the outer casing so as to provide a friction fit that holds the trim base in position inside the outer casing.

7. The recessed lighting fixture of claim 1, wherein the mounting mechanism comprises a hangar holder plate and a pin or screw attached to and extending inward from the plate and through an elongated opening formed in the side wall of the outer casing, enabling the outer casing to be adjusted vertically relative to the hangar bar.

8. The recessed lighting fixture of claim 7, wherein the outer casing can be adjusted vertically by more than one 1 inch.

9. The recessed lighting fixture of claim 7, wherein the outer casing can accommodate a ceiling or wall thickness of ½ inch to 2½ inches.

10. The recessed lighting fixture of claim 7, where the mounting mechanism is configured such that turning the screw clockwise raises or lowers the outer casing, and turning the screw counterclockwise lowers or raises the outer casing.

11. A recessed lighting fixture comprising:

a unified casting in which a) a light source module for emitting light and b) a driver for powering the light source module to emit light are housed together with a reflector and a lens as a single unit;

an outer casing that has a base end joined to one end of a side wall, and an inner surface of the base end and an inner surface of the side wall define a cavity, and wherein the side wall of the outer casing has another end that defines an opening of the cavity;

a ring that is attached to the side wall of the outer casing, the ring having a plurality of holes formed through a flat portion of, and in a thickness direction of, the ring, each hole to receive a respective fastener for securing the unified casting to the ring to thereby hold the unified casting inside the cavity of the outer casing; and a plurality of wire connectors within the outer casing to join a first plurality of wires, which carry electrical power with at least one of 120 VAC or 277 VAC and that extend into the casing to deliver the electrical power from a circuit breaker or wall switch, to a second plurality of wires extending out of the driver, wherein the outer casing serves as both a junction box to house the plurality of wire connectors and a luminaire enclosure.

12. The recessed lighting fixture of claim 11 wherein the outer casing is less than 5 inches in height between its base end and said another end of its side wall.

13. The recessed lighting fixture of claim 11 further comprising a trim for covering an opening in a ceiling or a wall behind which the outer casing is installed, wherein the trim has a) a trim base with an outer surface and b) a flange extending outwardly from the outer surface of the trim base, and wherein when the trim base is positioned inside the cavity of the outer casing, the flange lies against a front face of the ceiling or wall behind which the outer casing is installed.

14. The recessed lighting fixture of claim 13 further comprising a plurality of friction clips each being secured to the trim base at one end and free to contact the side wall of the outer casing at another end, and wherein the trim base is separately fastened to the unified casting.

* * * * *